US009669987B2

(12) United States Patent
Stahlecker

(10) Patent No.: US 9,669,987 B2
(45) Date of Patent: Jun. 6, 2017

(54) CUP AND METHOD FOR MANUFACTURING A CUP

(71) Applicant: Werner Stahlecker, Goeppingen (DE)

(72) Inventor: Werner Stahlecker, Goeppingen (DE)

(73) Assignee: PTM PACKAGING TOOLS MACHINERY PTE. LTD., Singapore (SG)

( * ) Notice: Subject to any disclaimer, the term of this patent is extended or adjusted under 35 U.S.C. 154(b) by 32 days.

(21) Appl. No.: 14/737,043

(22) Filed: Jun. 11, 2015

(65) Prior Publication Data

US 2015/0360845 A1 Dec. 17, 2015

(30) Foreign Application Priority Data

Jun. 12, 2014 (DE) ..... 10 2014 211 275

(51) Int. Cl.

| | |
|---|---|
| ***B65D 3/14*** | (2006.01) |
| ***B65D 3/22*** | (2006.01) |
| ***B65D 3/30*** | (2006.01) |
| ***B65D 81/38*** | (2006.01) |
| ***B65D 21/02*** | (2006.01) |
| ***B31B 17/00*** | (2006.01) |

(52) U.S. Cl.

CPC ..... *B65D 81/3874* (2013.01); *B31B 17/00* (2013.01); *B65D 3/14* (2013.01); *B65D 3/30* (2013.01); *B65D 21/0233* (2013.01)

(58) Field of Classification Search

None

See application file for complete search history.

(56) References Cited

U.S. PATENT DOCUMENTS

| | | | | |
|---|---|---|---|---|
| 5,542,599 | A * | 8/1996 | Sobol | A47J 41/0077 229/103.11 |
| 5,660,326 | A * | 8/1997 | Varano | B65D 3/22 220/739 |
| 5,685,480 | A * | 11/1997 | Choi | B65D 3/22 229/103.11 |
| 6,253,995 | B1 * | 7/2001 | Blok | B65D 81/3869 229/198.2 |
| 6,598,786 | B1 * | 7/2003 | Guo | B65D 81/3874 220/592.25 |
| 7,717,325 | B2 * | 5/2010 | Puls | B65D 81/3869 220/592.17 |
| 8,740,055 | B2 | 6/2014 | Stahlecker | |

(Continued)

FOREIGN PATENT DOCUMENTS

| | | |
|---|---|---|
| DE | 10 2011 078 479 A1 | 1/2013 |
| EP | 2 371 723 A1 | 10/2011 |

OTHER PUBLICATIONS

Search Report of European Patent Office issued in Application No. 15 16 8683.9 with English language translation of category of cited documents, dated Sep. 28, 2015 (8 pages).

*Primary Examiner* — Gary Elkins

(74) *Attorney, Agent, or Firm* — Flynn, Thiel, Boutell & Tanis, P.C.

(57) ABSTRACT

A cup made of a paper material or a material which can be processed in a similar manner to paper and which has a fillable interior, wherein the cup has a casing and an outer casing between which an insulating space is formed. The insulating space contains an insulating material which is prevented from escaping from the insulating space by at least one lower seal.

18 Claims, 28 Drawing Sheets

(56) References Cited

U.S. PATENT DOCUMENTS

| | | | | |
|---|---|---|---|---|
| 8,851,363 | B2 | 10/2014 | Stahlecker | |
| 2009/0321508 | A1 | 12/2009 | Fu et al. | |
| 2011/0240726 | A1 | 10/2011 | Stahlecker | |
| 2013/0001286 | A1 | 1/2013 | Stahlecker | |
| 2015/0108146 | A1* | 4/2015 | Jameson ..... | B65D 81/3869<br>220/592.16 |

* cited by examiner

CUP AND METHOD FOR MANUFACTURING A CUP

CROSS-REFERENCE TO RELATED APPLICATION

This application claims the priority of German Application No. 10 2014 211 275.3, filed on Jun. 12, 2014, the disclosure of which is hereby incorporated by reference in its entirety into this application.

FIELD, BACKGROUND AND SUMMARY OF THE INVENTION

The invention relates to a cup made of a paper material or a material which can be processed in a similar manner to paper and has a fillable interior which is formed by means of a casing which is conical at least in certain sections and a base. The base is connected in an essentially fluid-tight manner to the casing in the region of the lower end of the interior. The cup has an outer casing which surrounds the casing at least in certain sections, with the result that an insulating space is formed between the casing and the outer casing.

The insulating space serves here to keep a beverage contained in the interior warm for as long as possible. This is done, in particular, by preventing the transportation of heat between the beverage and the surrounding atmosphere.

It has become apparent that for specific applications the introduction of an insulating material into the insulating space can be advantageous. As a result, the insulating effect can be increased and a constant distance can be maintained between the outer casing and the casing. This can be advantageous, in particular, when gripping or compressing the cup while drinking. If the outer casing and the casing touch, the insulating effect is reduced to an undesired extent.

Suitable insulating materials are, for example, insulation materials insofar as they can be positioned between the outer casing and the casing by a process of whatever kind. However, it has become apparent that typical insulating materials have a certain degree of porosity or brittleness. It is therefore possible for the insulating material to "crumble", which does not necessarily worsen the insulating effect but can lead to a situation in which parts of the insulating material fall into another cup when cups are stacked together. This insulating material can float after a beverage has been placed in the cup and can irritate the customer of the hot beverage. In this case, the customer may assume that the beverage is contaminated and refuse to consume it.

The problems mentioned above lead to a situation in which, in the case of cups of the generic type, the use of insulating materials is frequently prohibited, in particular in the case of cups which are to be stacked one in the other.

The invention also relates to a method for manufacturing a cup in which the problem arises that the manufactured cup of the generic type is prone to the same disadvantages which have just been described above.

The invention is intended to specify a cup made of a paper material or a material which can be processed in a similar manner to paper, in which cup an insulating material is provided and which can nevertheless be stacked and handled without problems. Furthermore, an object of the invention is to provide a method for manufacturing such a cup.

The invention relates to a cup made of a paper material or a material which can be processed in a similar manner to paper and has a fillable interior which is formed by means of a casing which is conical at least in certain sections and a base. The base is connected in an essentially fluid-tight manner to the casing in the region of the lower end of the interior. The cup has an outer casing which surrounds the casing at least in certain sections, with the result that an insulating space is formed between the casing and the outer casing.

According to the invention there is provision that

- the insulating space is at least partially filled with insulating material, and
- a lower seal, which runs completely around the circumference, is formed at least underneath the insulating material to prevent the insulating material from escaping between the casing and the outer casing.

By means of the seal provided according to the invention it is effectively possible to prevent the insulating material from escaping on an underside of the cup. In typical stacked arrangements of such cups, this underside is normally located particularly low in another cup, with the result that in cups of the known type there is a particularly large risk that insulating material will enter another cup at this point. The cup according to the invention therefore permits the advantages which arise from the provision of an insulating material in the insulating space to be combined without problems with the advantages which arise from stacking the cups.

The paper material or the material which can be processed in a similar manner to paper is, in particular, a material which is resistant to the effect of typical beverages over typical periods of time in which the beverage is stored in the cup. For this purpose, plastic elements can also be integrated into the paper material. Likewise, it is possible to use a plastic material which can be processed in a similar manner to paper, wherein a conical sleeve and a pot-shaped base are therefore manufactured from planar material and then connected to form a finished cup.

The lower seal is preferably formed underneath the entire insulating material which is arranged between the casing and the outer casing. As a result, the sealing effect of the seal extends to the entire insulating material which is present in the cup. This can effectively prevent parts of an insulating material which is possibly arranged underneath the seal from dropping out.

According to one embodiment there is provision that

- the lower seal is formed by the outer casing being bonded, adhered or sealed to the casing at a lower shoulder,
- wherein the lower shoulder is formed on the outer casing and extends towards the casing.

As a result, an additional reinforcing effect of the shoulder can be obtained and the outer casing can easily be connected to the casing at a suitable point.

According to one alternative embodiment, the lower seal is formed by rolling the outer casing towards the casing and bonding, adhering or sealing it to the casing. The rolling process serves here, in particular, to maintain a distance between the outer casing and the casing.

According to one embodiment, the outer casing is spaced apart at its lower edge from the casing, and the lower seal is embodied in such a way that it is spaced apart from the edge further in the upward direction. In such an embodiment, it is possible to dispense with bending or rolling the outer casing.

In particular in this case the lower seal is preferably embodied in the form of a circumferential adhesive bead, pulp bead or sealing bead or in the form of a sealing lip. In this context, a circumferential bead can advantageously form a materially joined connection between the outer casing and the casing. A sealing lip is typically an element which protrudes from the casing towards the outer casing or else from the outer casing towards the casing. The sealing lip encloses here, in particular, the space between the outer casing and the casing in such a way that no parts of the insulating material can drop out in the downward direction. In this case, a bonded connection is typically provided spaced apart from the sealing lip, which bonded connection ensures that the outer casing is arranged sufficiently close to the casing that the outer casing presses with a certain stress against the sealing lip or that the sealing lip presses with a certain stress against the casing. Therefore, the sealing effect which is necessary here can be achieved even without a materially joined connection or adhesive bond having to be formed between the outer casing and the inner casing at the seal.

According to one preferred embodiment there is provision that above the insulating material, a circumferential upper seal is formed completely around the circumference in order to prevent the insulating material from escaping between the casing and the outer casing. Therefore, insulating material can be prevented from escaping even at an upper side of the cup. This is relevant, in particular, when the cup is stored upside down, for example, during transportation or else for the purpose of storage in a system catering restaurant, i.e. the interior is open in the downward direction in this state. This permits, for example, the penetration of dust or of undesired objects into the interior to be prevented.

The upper seal is preferably formed above the entire insulating material which is arranged between the casing and the outer casing. Therefore, the sealing effect of the seal extends over the entire insulating material which is present in the cup. This can effectively prevent parts of an insulating material which is possibly arranged above the seal from dropping out.

According to one embodiment there is provision that the upper seal is formed by bonding, adhering or sealing the outer casing to the casing at an upper shoulder, wherein the upper shoulder is formed on the outer casing and extends towards the casing.

Therefore, an additional reinforcing effect of the shoulder can be achieved and the outer casing can be easily connected to the casing at a suitable point.

According to an alternative embodiment, the upper seal is formed in that the outer casing is rolled towards the casing and is bonded, adhered or sealed to the casing. The rolling serves here, in particular, to maintain a distance between the outer casing and the casing.

According to one embodiment, the outer casing is spaced apart at its upper edge from the casing, and the upper seal is embodied in such a way that it is spaced apart from the edge further in the downward direction. With such an embodiment, it is possible to dispense with bending or rolling of the outer casing.

In particular, in this case, the upper seal is preferably embodied in the form of a circumferential adhesive bead, pulp bead or sealing bead or in the form of a sealing lip. In this context, a circumferential bead can advantageously produce a materially joined connection between the outer casing and the casing. Reference should be made to the statements further above with respect to the use of a sealing lip.

A number of completely circumferential, central seals are preferably arranged between the casing and the outer casing, wherein insulating material is arranged both underneath and above each central seal. Therefore, a seal which acts only for a part of the insulating material contained can be also provided along a vertical direction of the cup. This can be advantageous, for example, if so much insulating material is arranged above such a central seal that a single lower or upper seal would no longer be sufficient effectively to prevent said material from escaping. By means of the central seal, the quantity of insulating material which can be contained in the insulating space can therefore also be increased.

According to one embodiment, the insulating material is formed in one or more large-area layers. In an embodiment which is an alternative to this, or even can be combined therewith, the insulating material is formed in one or more circumferential beads. Large-area layers typically extend over a considerable part of the cup in the vertical direction here. On the other hand, circumferential beads typically have a vertical extent which is considerably smaller than the entire vertical extent of the cup.

According to one embodiment, a number of central bonding points are arranged between the casing and the outer casing, wherein the central bonding points are arranged over the lower seal and under an upper edge of the outer casing and/or under the upper seal. Such bonding points can be suitable, in particular, for bonding the outer casing to the casing when sealing lips are used, wherein such a bonded connection can, for example, be made in a vertically central fashion. This is advantageous, in particular, insofar as the sealing lips themselves do not provide a materially joined connection or adhesive bond and therefore also no holding effect. Furthermore, in order to bring about the sealing effect of sealing lips a certain degree of prestress has to be achieved, as has been described further above. Such prestress can also be achieved with the bonding points just mentioned.

In contrast to the central seals mentioned further above, a bonding point does not necessarily have to be embodied running completely around, since it does not have the function of preventing insulating material from escaping but merely has the function of holding the outer casing against the casing.

According to respective embodiments, one, a plurality of or all of the seals can be embodied by means of a hot-melt adhesive, which can also be referred to as a hot melt. Likewise, one, a plurality of or all of the seals can be embodied by means of pulp. Such embodiments have proven advantageous.

The insulating material is advantageously formed from a physiologically harmless material. In particular, maize starch can be used for this. Therefore, it is possible to ensure that even in the event of a seal failing and the insulating material undesirably entering a beverage, there is no risk of damage to health.

In order to stack cups, a correspondingly long skirt, which can rest on a cup lying underneath it, can preferably be provided, or else a stacking shoulder which is formed on the inside in the cup can be provided. This facilitates the stacking of cups, since in this way a defined distance is maintained between stacked cups. Excessive tilting of the cups, which under certain circumstances leads to permanent deformations of the cups or to difficulties when removing cups from a stack, can therefore be effectively avoided. The stacking shoulder is preferably running all around but can also be formed only in certain sections.

The invention also relates to a method for manufacturing a cup according to the invention made of paper material or a material which can be processed in a similar manner to paper, wherein the method comprises the following steps:

essentially fluid-tight connection of a conical casing and of a base, application of an insulating material to the casing, attachment of an outer casing to the casing, and formation of at least one seal to prevent the insulating material from escaping between the outer casing and the casing.

By means of the method according to the invention it is possible to manufacture a cup which has the advantages already mentioned further above. With respect to the cup it is possible here to have recourse to all the variants and embodiments described further above. Explained advantages apply correspondingly.

It will be understood that the aforementioned steps can be carried out in the specified sequence, but also in another sequence. For example, the insulating material can firstly be applied to the casing and subsequently the outer casing can be attached to the casing. Alternatively, for example the outer casing can firstly be attached to the casing and subsequently insulating material can be introduced into the insulating space formed as a result. Likewise, the seal can be implemented before or after the application of the insulating material. This applies both to the lower and also to a possible upper seal.

BRIEF DESCRIPTION OF THE DRAWINGS

Further features and advantages will become apparent to a person skilled in the art on considering the exemplary embodiments described below with reference to the appended drawing. Individual features of the exemplary embodiments which are described and illustrated can be combined here in any desired fashion without exceeding the scope of the invention.

In the drawings.

DETAILED DESCRIPTION

Figure 1:
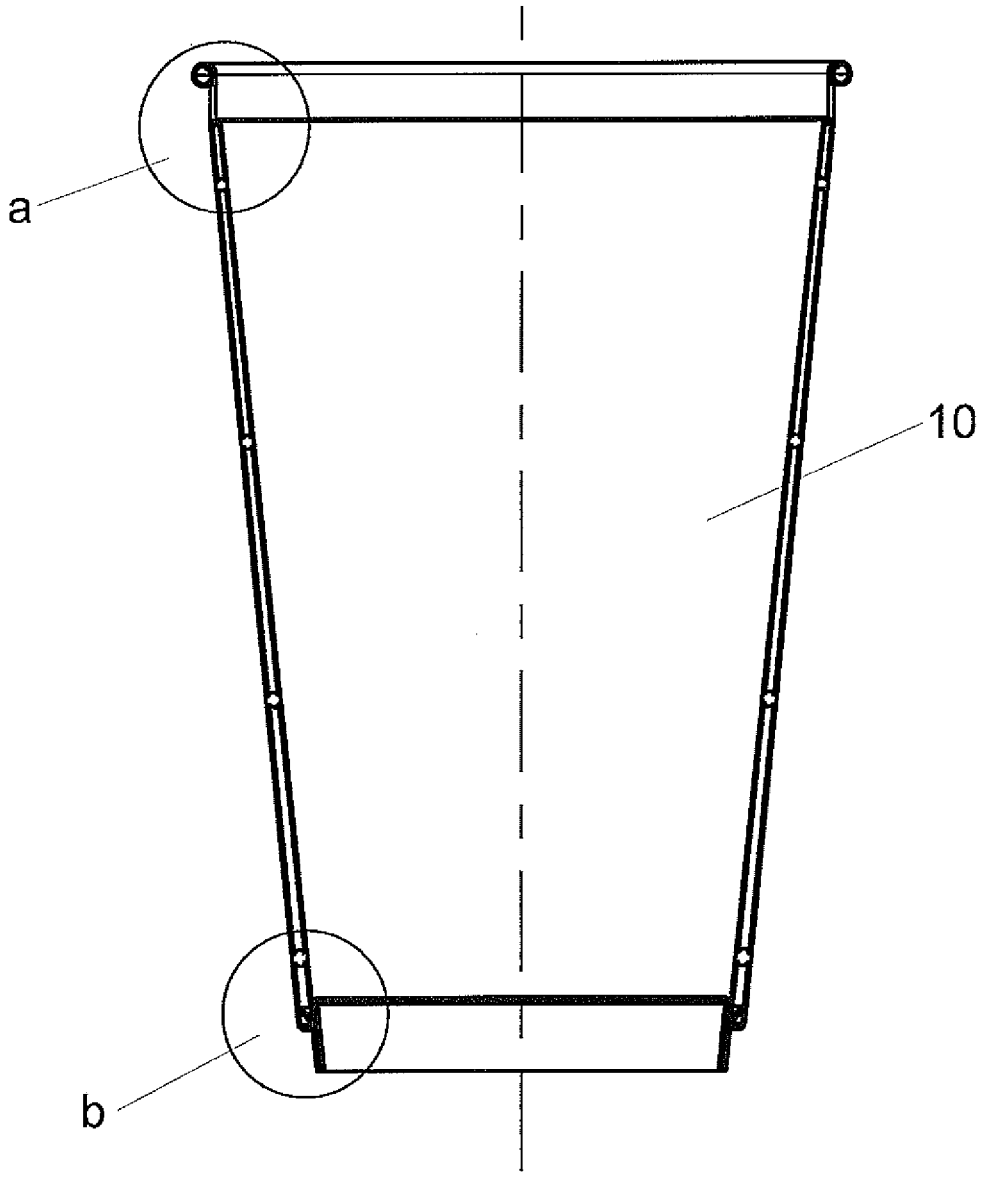
FIGS. 1, 1*a*, 1*b*: show a schematic sectional view through a cup according to a first exemplary embodiment.

In total eight different embodiments of a cup 10 are illustrated below. In each case an overall view of the respective cup 10 is firstly provided here in a figure which does not have any letter in its designation. Respective upper and lower regions are marked in this figure and characterized by "a" and "b", respectively. These regions are illustrated in more detail in the respective figures characterized by "a" and "b", respectively. A number of exemplary embodiments are additionally also illustrated with a further figure which illustrates cups which are stacked one in the other. This figure is characterized by the letter "c".

All the exemplary embodiments have in common the fact that the respective cup 10 has a casing 20 and an outer casing 30. The casing 20 bounds in certain sections a fillable interior in which a beverage, in particular a hot beverage, can be accommodated. The casing 30 is embodied here in a conical fashion. In the region of its lower end, the interior which is formed by the casing 20 is closed off by a pot-shaped base 24 which is attached to the casing 20 by virtue of the fact that the casing 20 is bent over at its lower end, and a circumferential base wall of the base 24 is bonded, sealed and/or pressed between two sections of the casing 20. This embodiment of the base 24 which is shown is merely by way of example, and the specific configuration of the base is not the deciding factor for the embodiment of the invention described here. For example, the base 24 and the casing 20 could also be embodied in one piece.

The outer casing 30 is attached to the casing 20 in a suitable way. This can be done, for example, by means of suitable adhesive beads which are arranged between the casing 20 and the outer casing 30. Said beads can be embodied to run around or else only in certain sections. The adhesive beads do not have to perform a sealing effect in all cases even though a number of exemplary embodiments are also described further below in which they also have a sealing effect. Alternatively, the outer casing 30 can also be sealed to the casing 20.

An insulating space 40 is formed between the casing 20 and the outer casing 30. Said insulating space serves to inhibit the transportation of heat between a hot beverage or cold beverage contained in the cup and the surroundings. The insulating space 40 is at least partially filled with insulating material, wherein, depending on the exemplary embodiment, the insulating material can be a bead-shaped insulating material 50 or a planar insulating material 52. More details on this will be given during the discussion of the exemplary embodiments. Apart from the respective insulating material 50, 52, the insulating space 40 is filled here with air.

In order to prevent the insulating material 50, 52 from escaping between the casing 20 and the outer casing 30, the cups 10 according to the respective exemplary embodiments each have a lower seal 60 and an upper seal 70. A description of how these seals 60, 70 are respectively embodied in precise terms will be given below with respect to the individual exemplary embodiments.

At the upper edge, the casing 20 has a mouth roll 22 which ensures in a manner known per se that the beverage which is accommodated in the cup 10 can be drunk pleasantly. In particular, the mouth roll 22 stabilizes an edge of the casing 20 at which a person usually starts to drink.

Figure 1A:
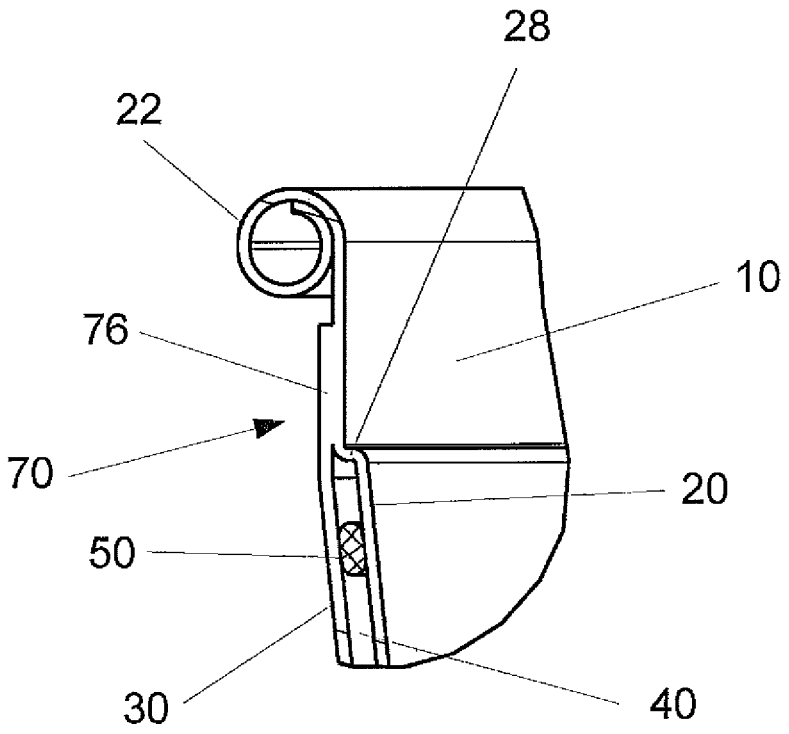
Figure 1B:
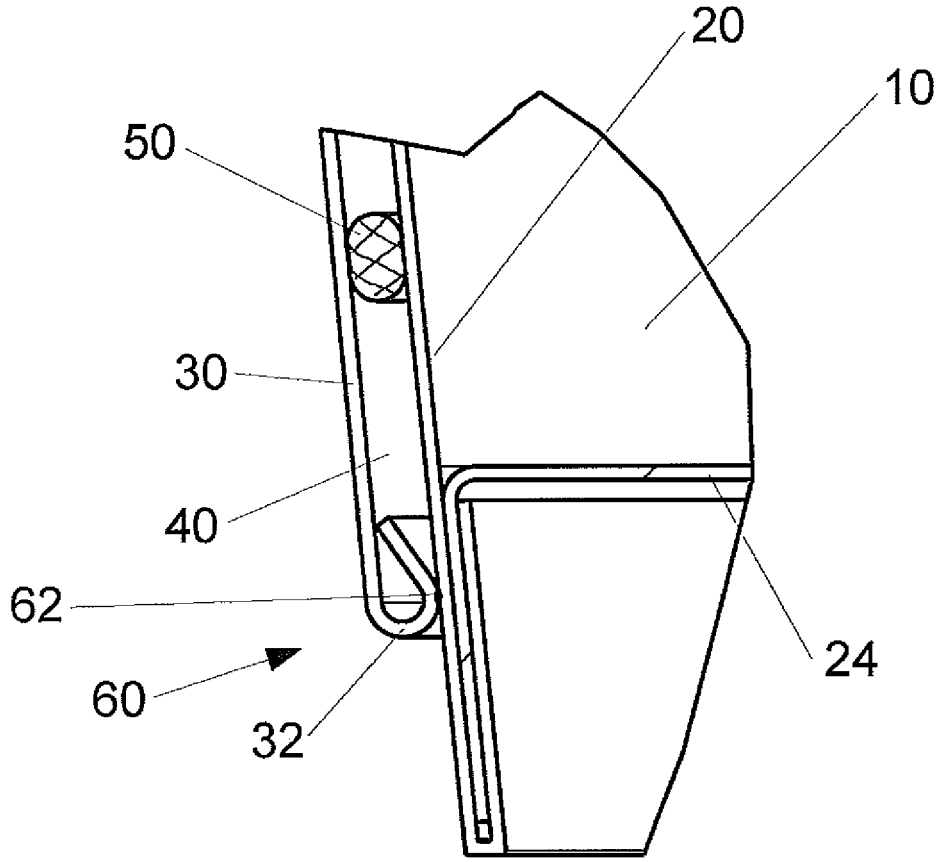

FIGS. 1, 1*a* and 1*b* show a cup 10 according to a first exemplary embodiment of the invention.

The upper seal 70 is embodied here in such a way that the casing 20 is bent towards the outer casing 30 and in the process forms an upper shoulder 28 which can also be referred to as a shoulder. Above the upper shoulder 28 the outer casing 30 and the casing 20 are bonded to one another along an upper planar bonded connection 76. Since in this context a materially joined connection or adhesive bond has been formed, no insulating material 50 can escape through the upper seal 70.

The lower seal 60 is embodied in this first exemplary embodiment by rolling in the outer casing 30 on its underside and forming a lower, rolled-in region 32. A lower, linear bonded connection 62, which forms a materially joined connection or adhesive bond between the outer casing 30 and the casing 20, is formed at the lower, rolled-in region 32, towards the casing 20. A distance between the outer casing 30 and the casing 20 is defined by means of the lower, rolled-in region 32. In addition, the bead-shaped insulating material 50 contained in the insulating space 40 is prevented from escaping by this lower, rolled-in region 32 together with the lower, linear bonded connection 62.

Figure 2:
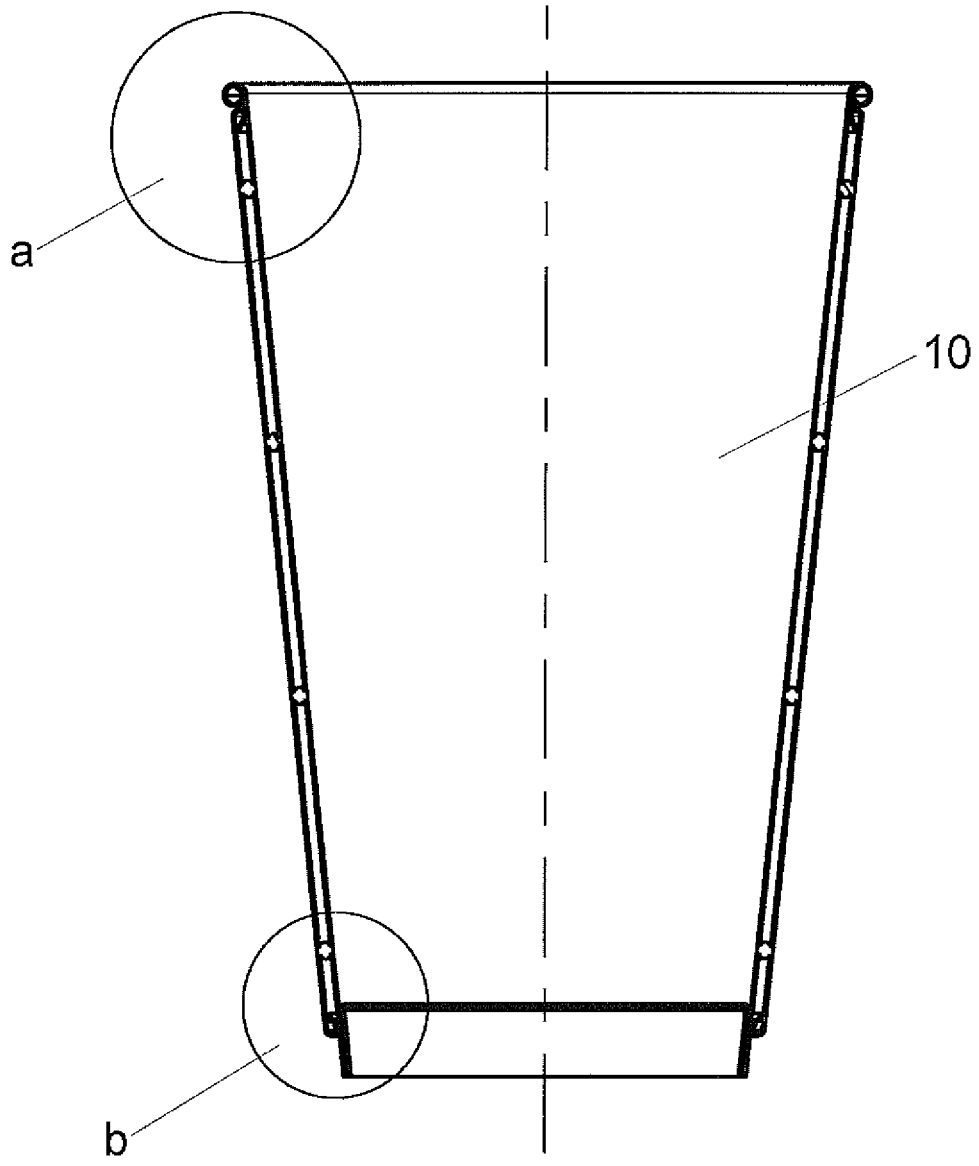
FIGS. 2, 2*a*, 2*b*: show a schematic sectional view through a cup according to a second exemplary embodiment.
Figure 2A:
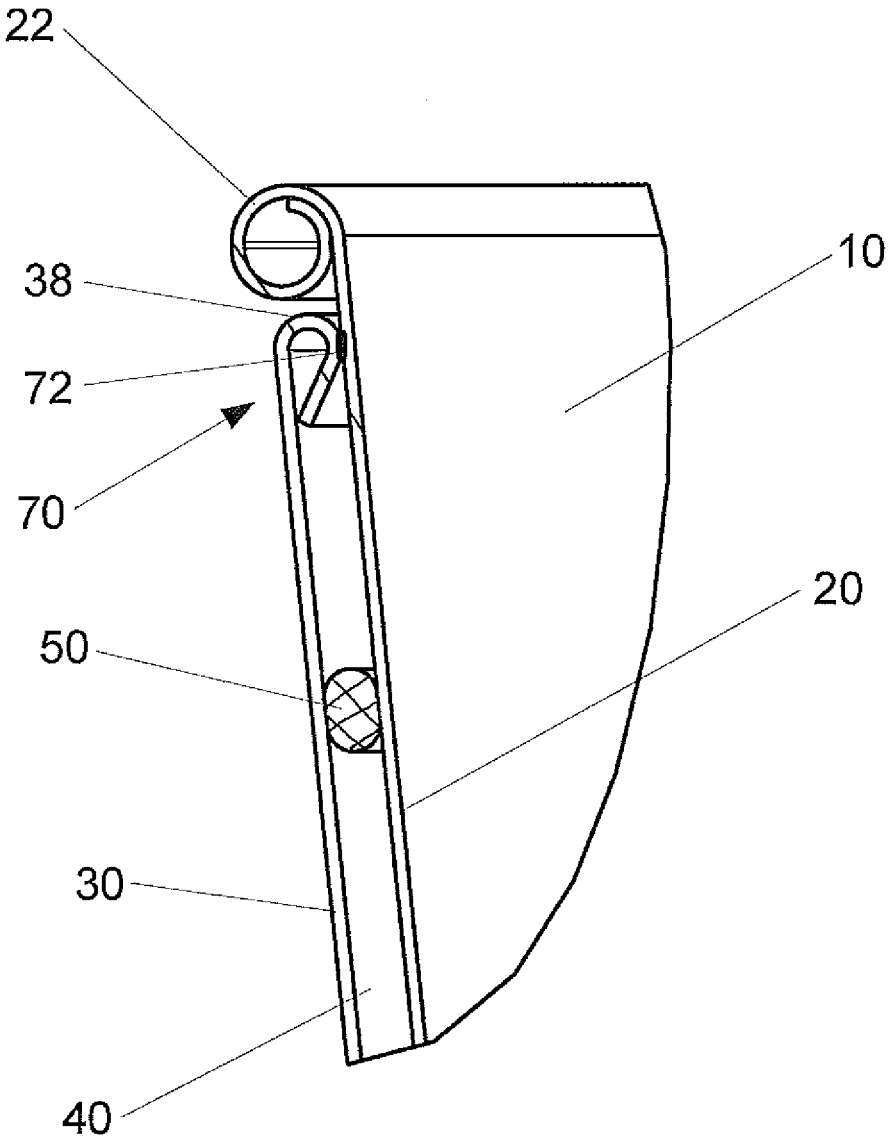
Figure 2B:
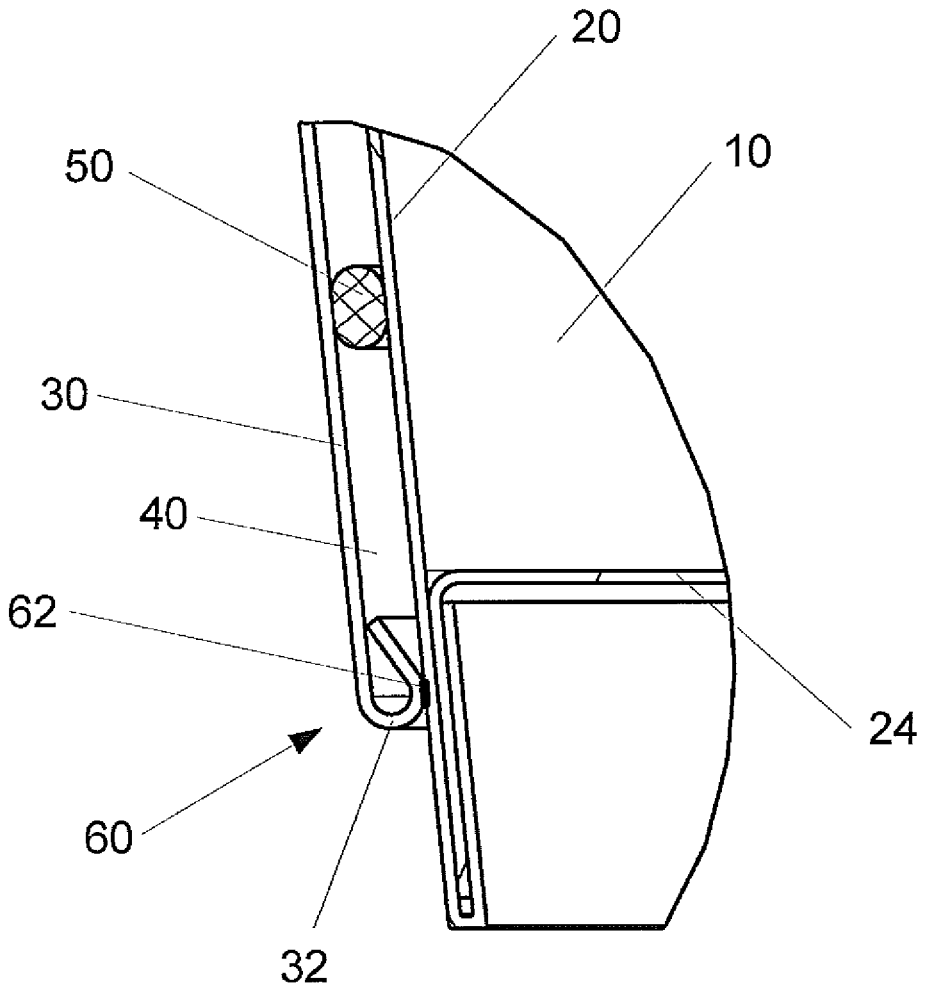

FIGS. 2, 2*a* and 2*b* show a cup 10 according to a second exemplary embodiment of the invention. The lower seal 60 is embodied in an identical way to the first exemplary embodiment here. Therefore, a renewed description is not given.

The upper seal 70 is embodied in the same way as the lower seal 60, i.e. the outer casing 30 forms an upper, rolled-in region 38 at its upper end, wherein an upper linear bonded connection 72 is formed between this upper, rolled-in region 38 and the casing 20. Therefore, an upper seal 70 is produced in the same way as has just been described with respect to the lower seal 60, which upper seal 70 prevents the insulating material 50 contained in the insulating space 40 from escaping.

Figure 3:
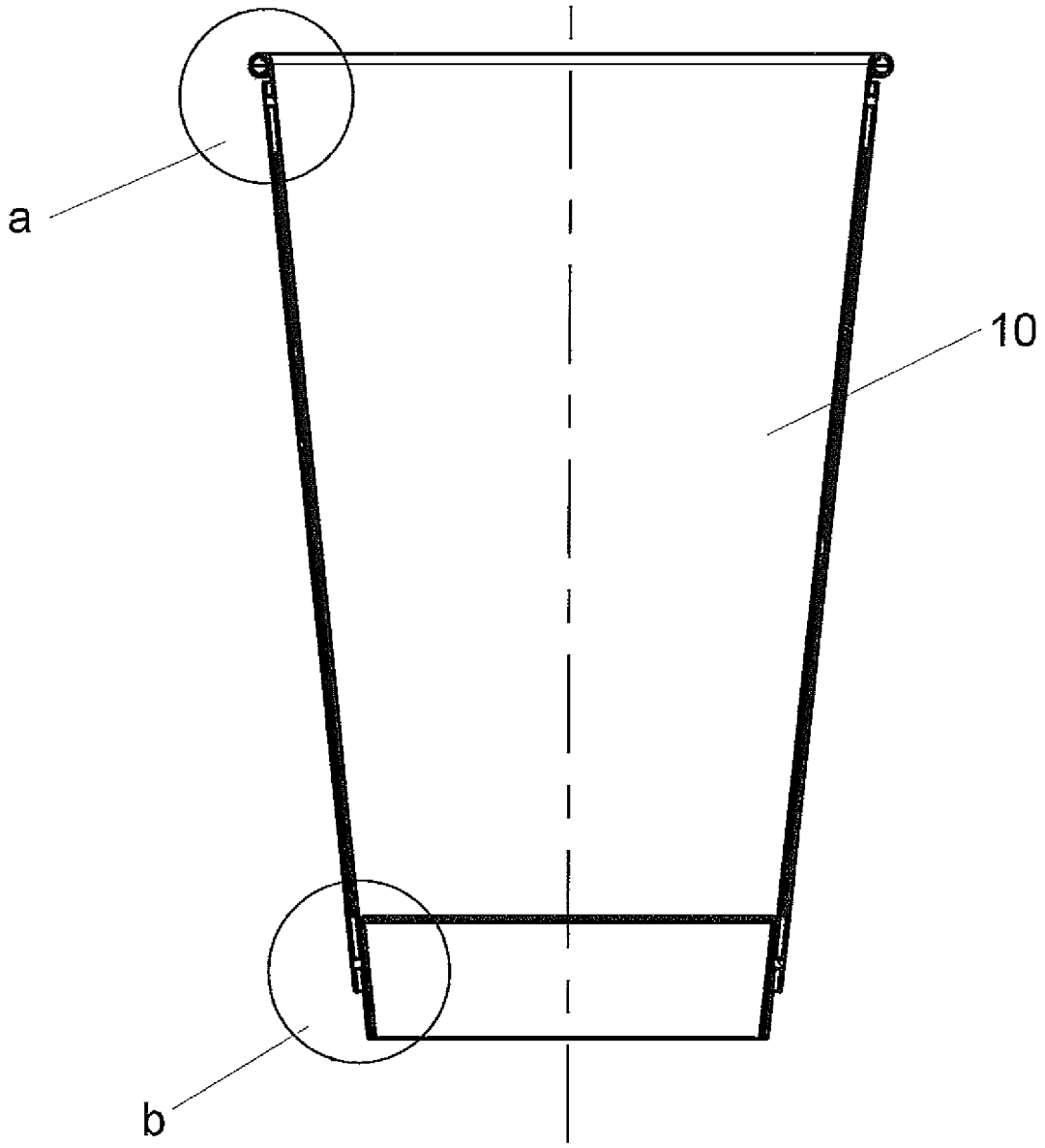
FIGS. 3, 3*a*, 3*b*: show a schematic sectional view through a cup according to a third exemplary embodiment.
Figure 3A:
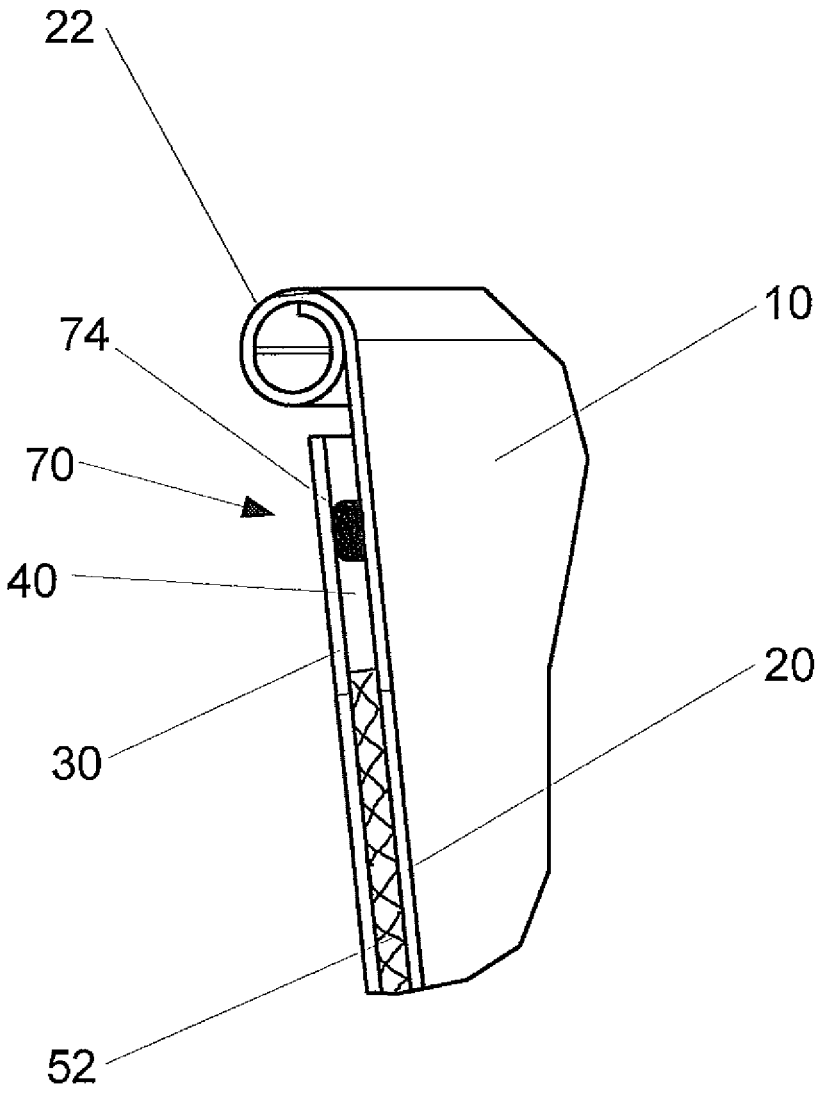
Figure 3B:
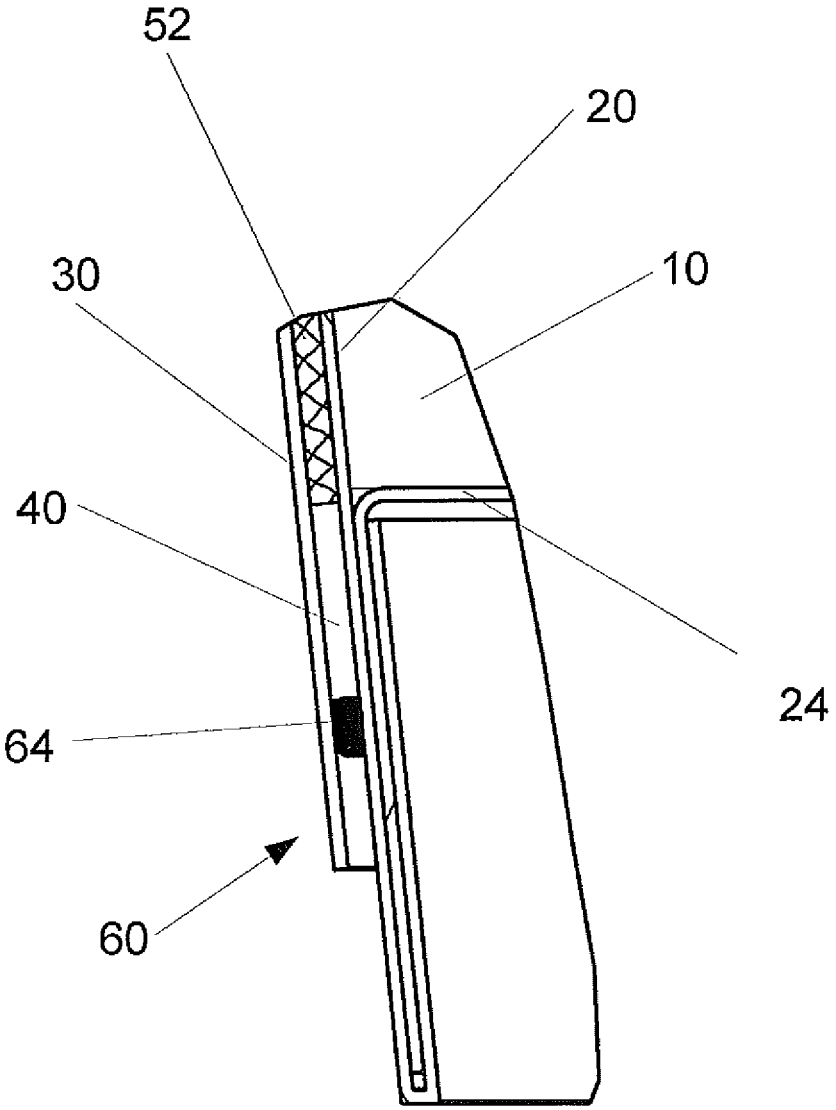

FIGS. 3, 3*a* and 3*b* show a cup 10 according to a third exemplary embodiment of the invention. The upper seal 70 is embodied here in such a way that the outer casing 30 is spaced apart at its upper end from the casing 20 and an upper adhesive bead 74 is formed between the casing 20 and the outer casing 30, somewhat below the upper edge. This upper adhesive bead 74 runs completely around the entire circumference of the cup 10, with the result that the insulating material 52 which is planar here cannot move past it. This permits the desired sealing effect of the upper adhesive bead 72.

The lower seal 60 is embodied in this exemplary embodiment in the same way as the upper seal 70. The outer casing 30 is spaced apart at a lower edge from the casing 20, and a lower adhesive bead 64 is arranged between the casing 20 and the outer casing 30 somewhat above this lower edge, which lower adhesive bead 64 produces a materially joined connection or adhesive bond between the casing 20 and the outer casing 30. The lower adhesive bead 64 also runs completely around the entire circumference of the cup 10. It therefore prevents the planar insulating material 52, which is arranged in the insulating space 40 according to this exemplary embodiment, from escaping at the underside of the cup 10. The lower adhesive bead 64 is arranged underneath the base 24, and the outer casing extends to under the base 24.

FIGS. 4, 4*a*, 4*b* and 4*c* show a cup 10 according to a fourth exemplary embodiment of the invention. The upper seal is embodied in an identical way to the third exemplary embodiment here. Therefore, more details are not given about this.

The lower seal 60 is in principle also embodied in the same way as the lower seal 60 according to the third exemplary embodiment, wherein in addition the inner casing 20 has a stacking shoulder 26 which is formed above the lower seal 60. This stacking shoulder 26 is composed here of a region which runs around and in which the casing 20 is bent over towards the outer casing 30, and therefore makes available a supporting surface for another cup. Therefore, when cups 10 are stacked together it is possible to avoid a situation in which they stick one in the other and the removal of the cups 10 is made more difficult.

In the fourth exemplary embodiment, the outer casing 30 is at a distance from the casing 20 at the lower edge, which distance is reduced compared to the third exemplary embodiment. This is because the skirt on which the circumferential wall of the base is held between two sections of the outer casing 30 and bonded or sealed widens again up to the lower edge of the cup.

Figure 4:
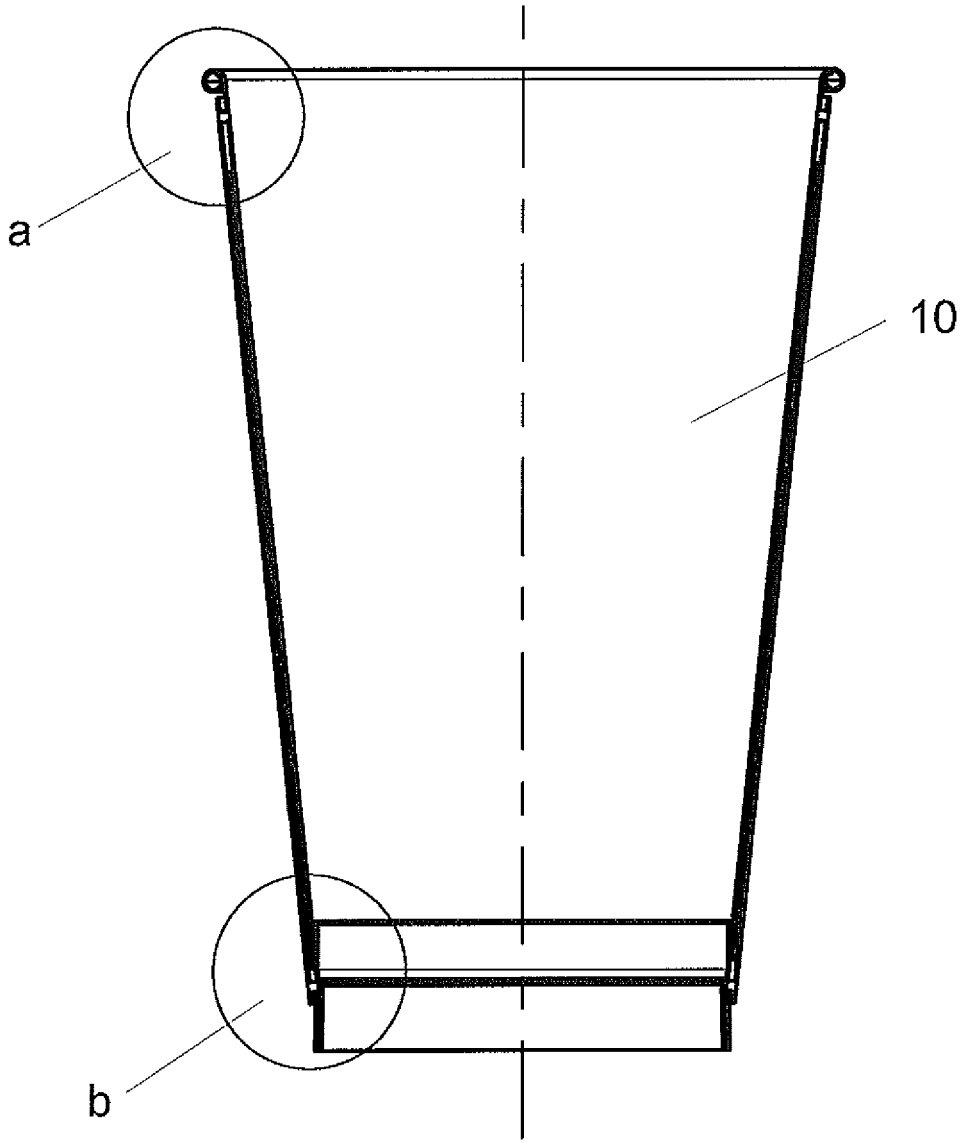
FIGS. 4, 4*a*, 4*b*, 4*c*: show a schematic sectional view through a cup according to a fourth exemplary embodiment.
Figure 4A:
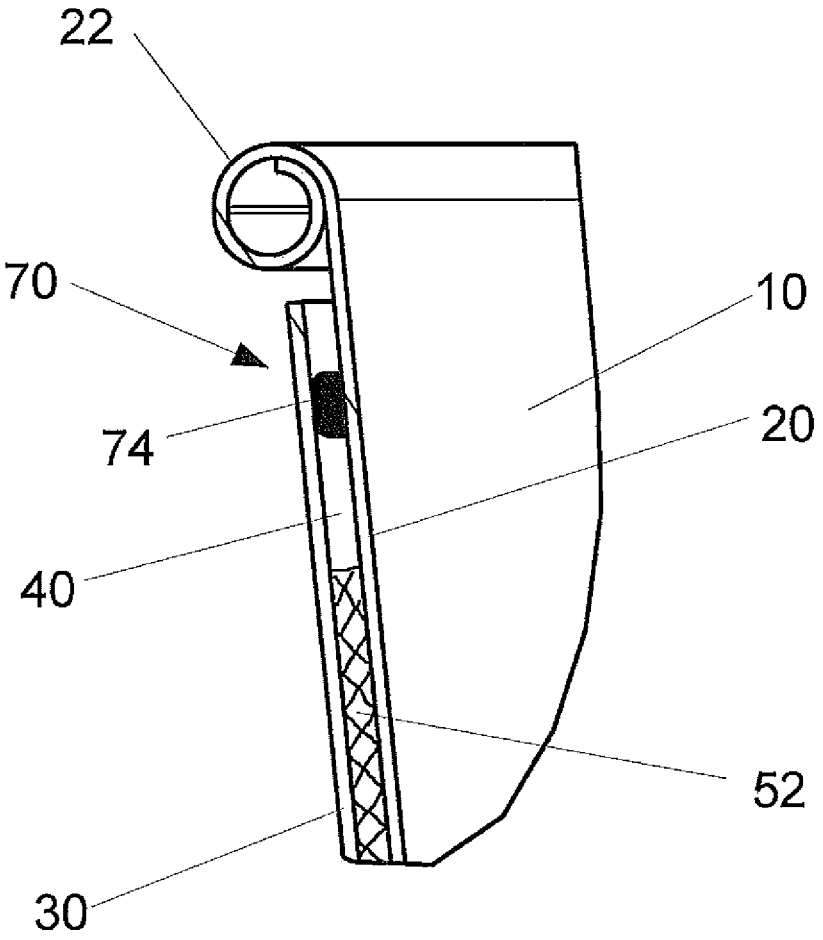
Figure 4B:
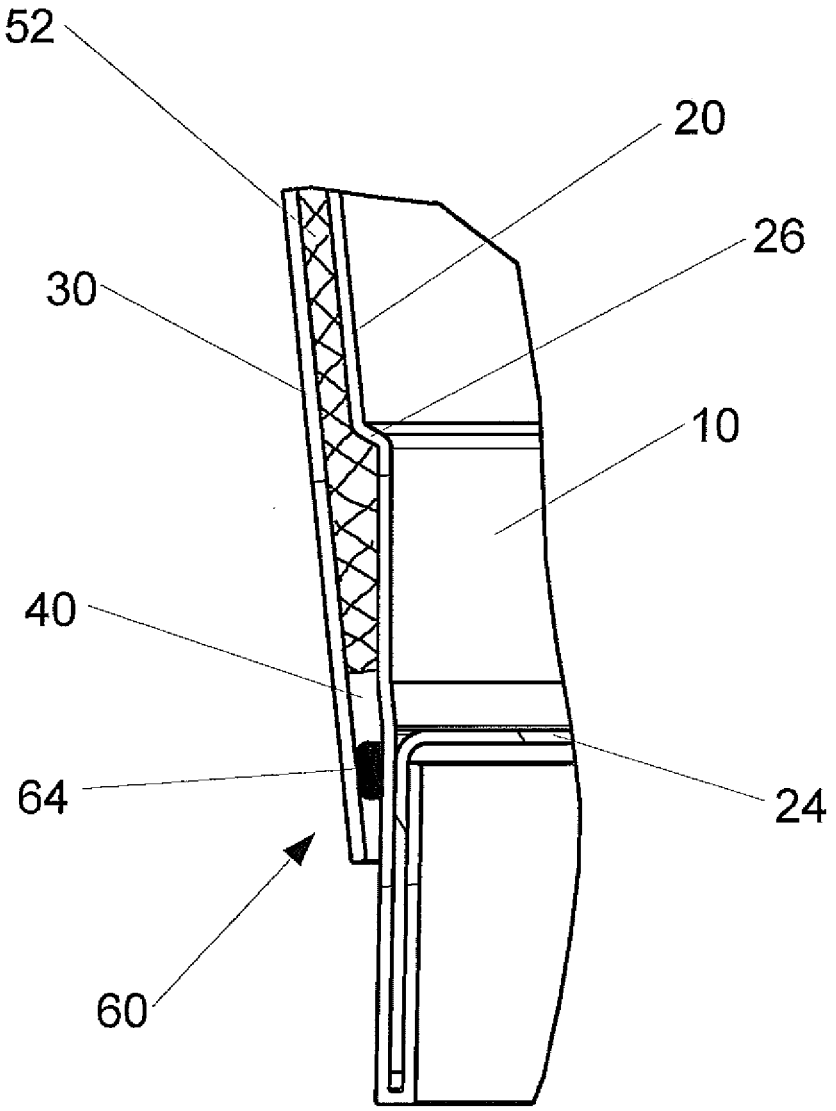
Figure 4C:
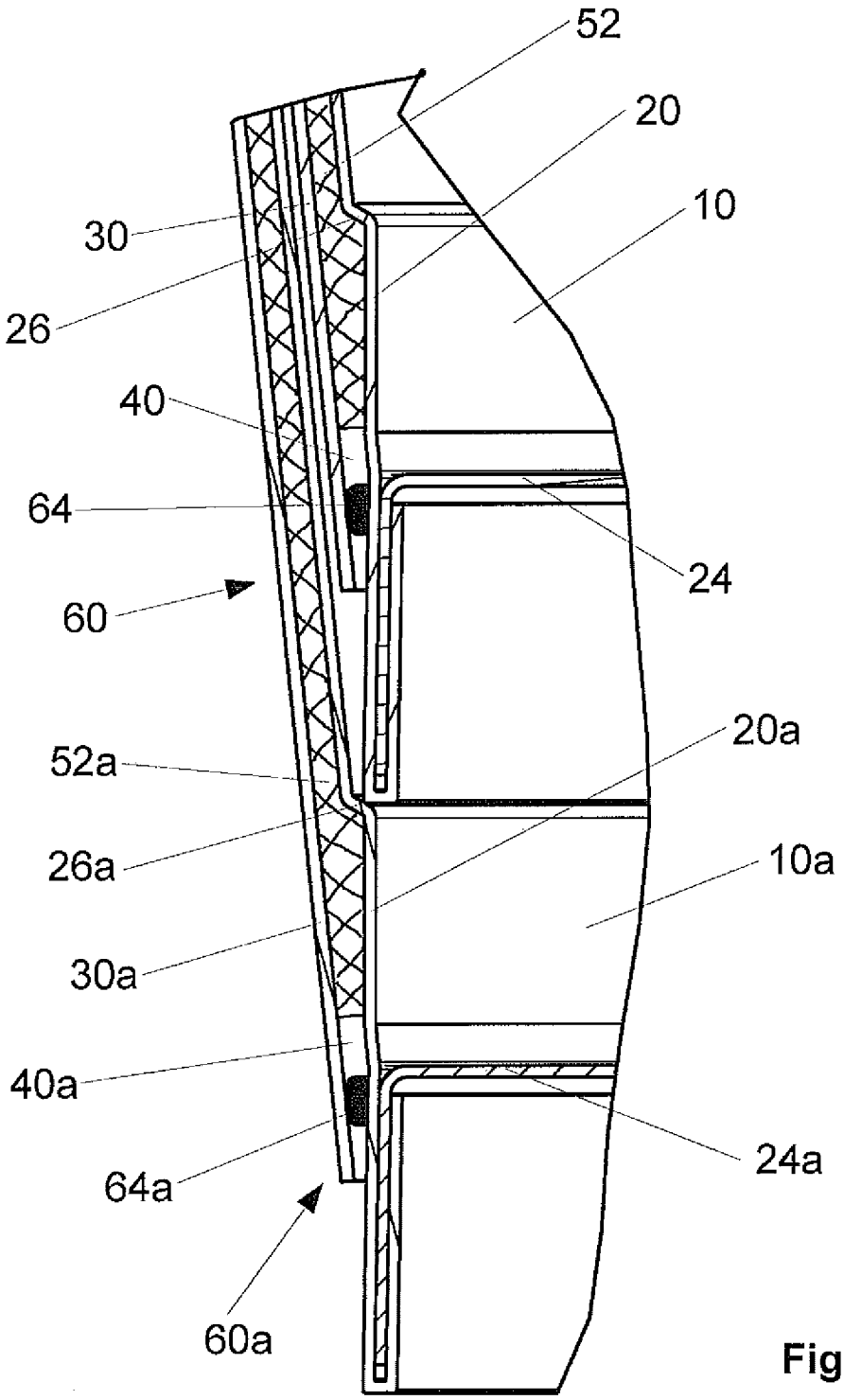

Exemplary stacking of an upper cup 10 into a lower cup 10*a* is illustrated in FIG. 4*c*. In this context it is apparent that the upper cup 10 rests with its lower end, formed by the skirt, but the part of the casing 20 which is bent over by 180° in order to secure the base 24, on the stacking shoulder 26*a* of the lower cup 10*a*. Reference is made to the entirety of the description which has already been given with respect to the individual components of the cups 10, 10*a*, wherein it is merely to be noted that all the components of the lower cup 10*a* are provided with the letter "a". Furthermore, from FIG. 4*c* it is also apparent that according to this exemplary embodiment a planar insulating material 52, which takes up a large part of the insulating space 40, is present in the insulating space 40. The insulating material 52 is also present in the region of the stacking shoulder 2 and can contribute to stabilizing the stacking shoulder.

FIGS. 5, 5*a*, 5*b* and 5*c* show a cup 10 according to a fifth exemplary embodiment of the invention. The upper seal 70 is embodied here in an identical way to the first exemplary embodiment. The lower seal 60 is embodied here in an identical way to the fourth exemplary embodiment. The stacking shoulder is also embodied in an identical way to the fourth exemplary embodiment. For this reason, reference is made to the descriptions already given further above and there is no repetition.

In contrast to the fourth exemplary embodiment, the cup 10 according to the fifth exemplary embodiment does not have a planar insulating material 52 but rather a bead-shaped insulating material 50. Therefore, a substantially larger part of the insulating space 40 is filled with air. The bead-shaped insulating material 50 serves in this case essentially to maintain a defined distance between the casing 20 and the outer casing 30.

Figure 5:
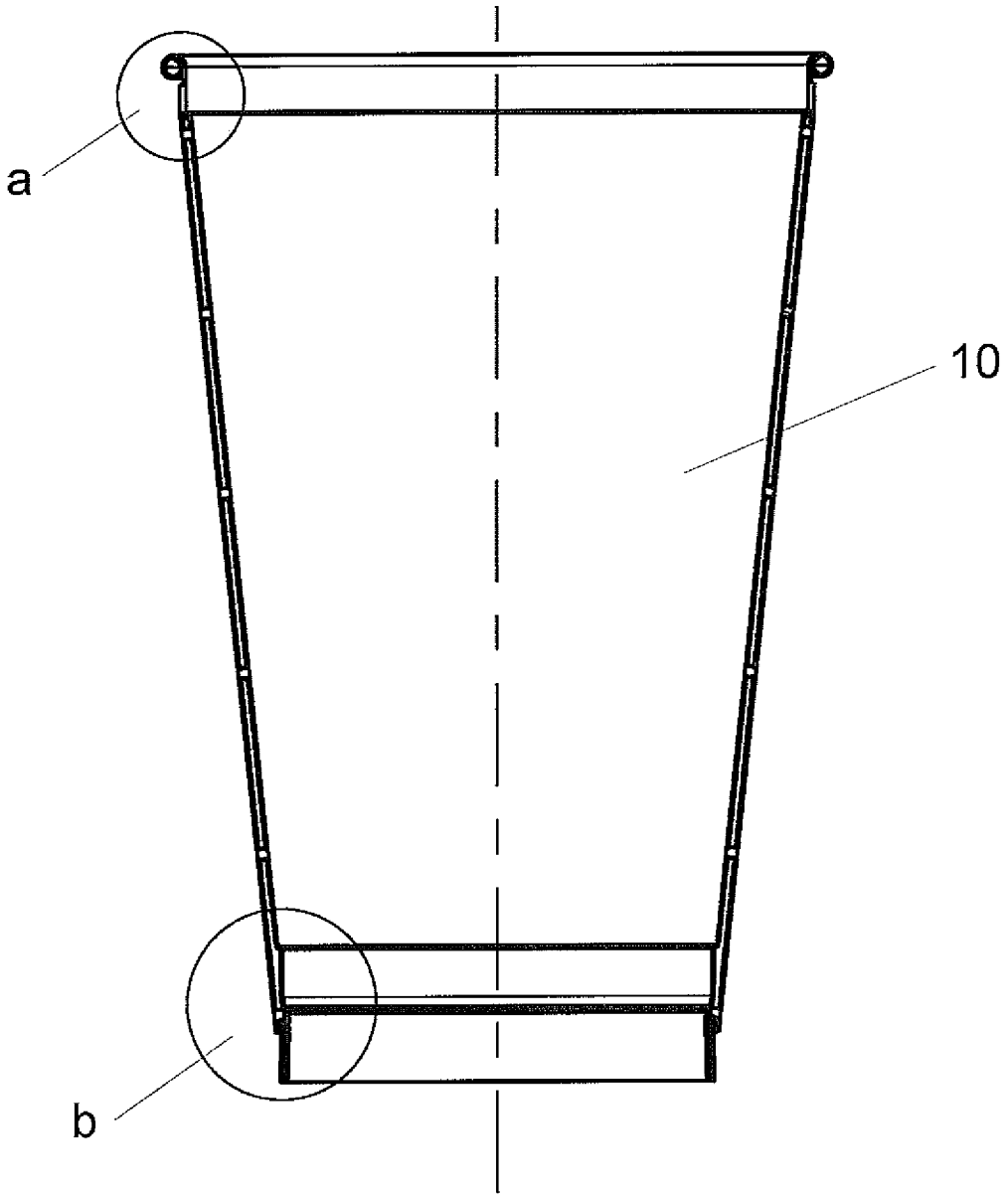
FIGS. 5, 5*a*, 5*b*, 5*c*: show a schematic sectional view through a cup according to a fifth exemplary embodiment.
Figure 5A:
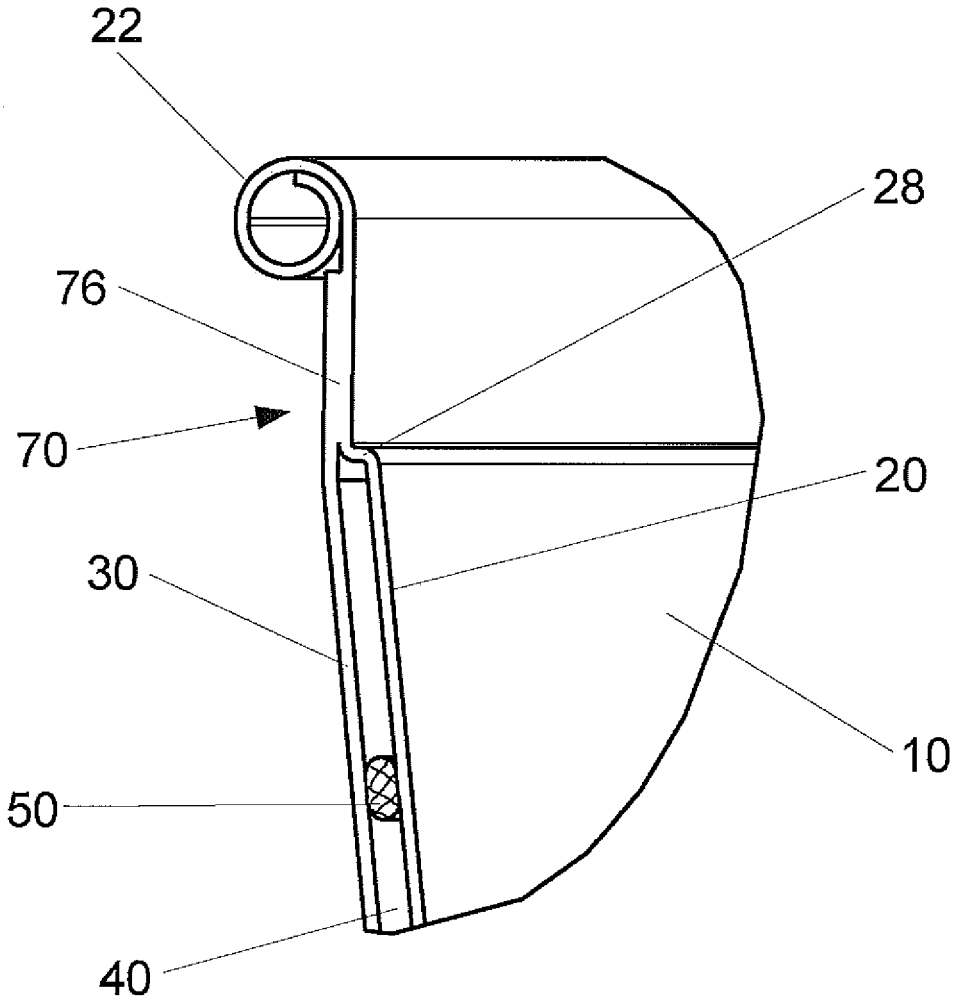
Figure 5B:
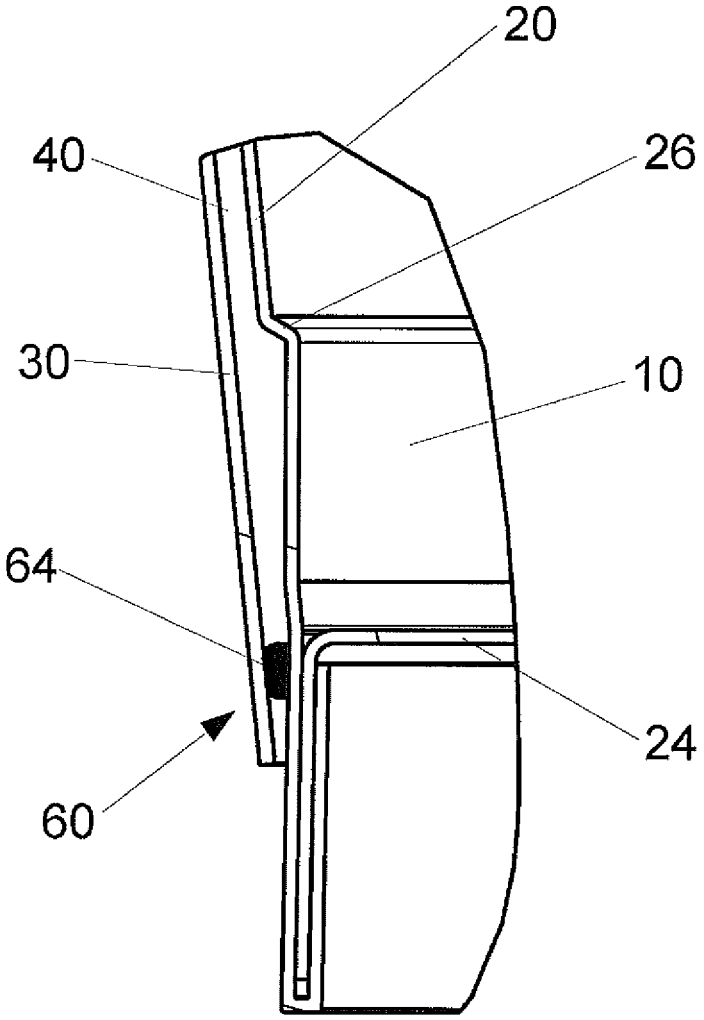
Figure 5C:
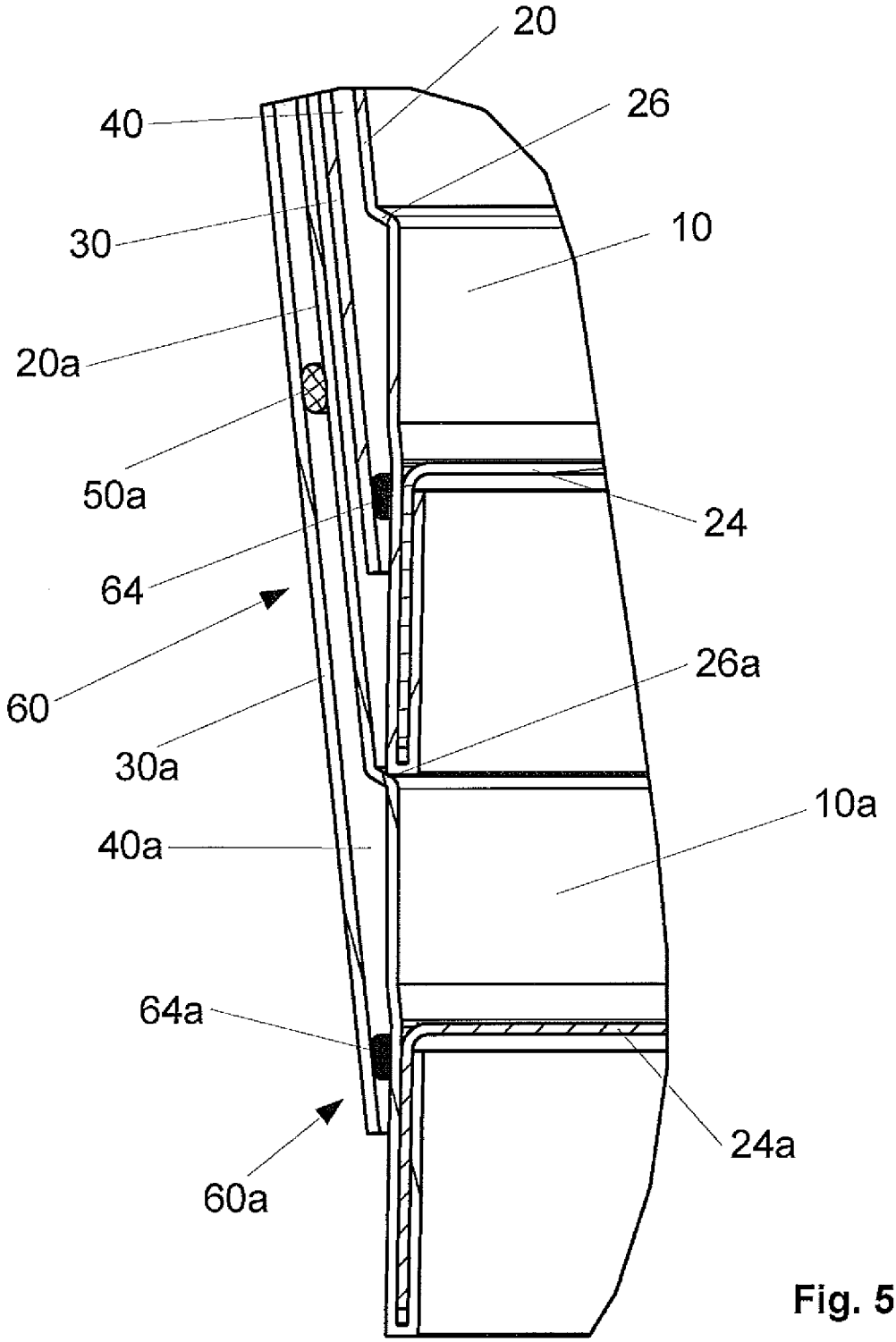

FIG. 5*c* shows in turn two cups 10, 10*a* which are stacked one on top of the other, wherein the upper cup is in turn denoted by the reference 10, and the lower cup is denoted by the reference 10*a*. Reference is made to the description which has already been given with respect to the individual components of the cups 10, 10*a*. The components of the lower cup 10*a* are in turn characterized by the letter "a". As is also presented further above in FIG. 4*c* with respect to the fourth exemplary embodiment, it is also apparent in FIG. 5*c* that the upper cup 10 is suitably supported on the stacking shoulder 26*a* of the lower cup 10*a*, with the result that the latter cannot be completely inserted into the lower cup 10*a*. This advantageously prevents the cups 10, 10*a* from becoming stuck.

FIGS. 6, 6*a*, 6*b* and 6*c* show a cup 10 according to a sixth exemplary embodiment of the invention.

The upper seal 70 is embodied here in such a way that the outer casing 30 is spaced apart at its upper edge from the casing 20, and a sealing lip 78 is arranged somewhat underneath this edge. It is to be noted that a materially joined connection or adhesive bond is not formed between the casing 30 and the sealing lip 78. Instead, the outer casing 30 rests with a certain prestress on the sealing lip 78. This prestress is brought about by a bonded connection (not illustrated) between the casing 20 and the outer casing 30 of the cup 10, which bonded connection is arranged, for example, at the height of the vertical centre of the cup 10. The prestress is sufficient to ensure that an insulating material which is present in the form of a bead-shaped insulating material 50 according to this exemplary embodiment cannot escape from the insulating space 40 between the sealing lip 78 and the outer casing 30. The lower seal 60 is embodied in the same way, wherein the outer casing 30 is spaced apart at its lower edge from the casing 20, and a lower sealing lip 68 is formed on the casing 20 somewhat above said lower edge, which lower sealing lip 68 extends towards the outer casing 30. The outer casing 30 also bears with a certain prestress against this lower sealing lip 68, which prestress is generated by the bonded connection which has already been described. This also prevents insulating material 50 from escaping from the insulating space 40.

Figure 6:
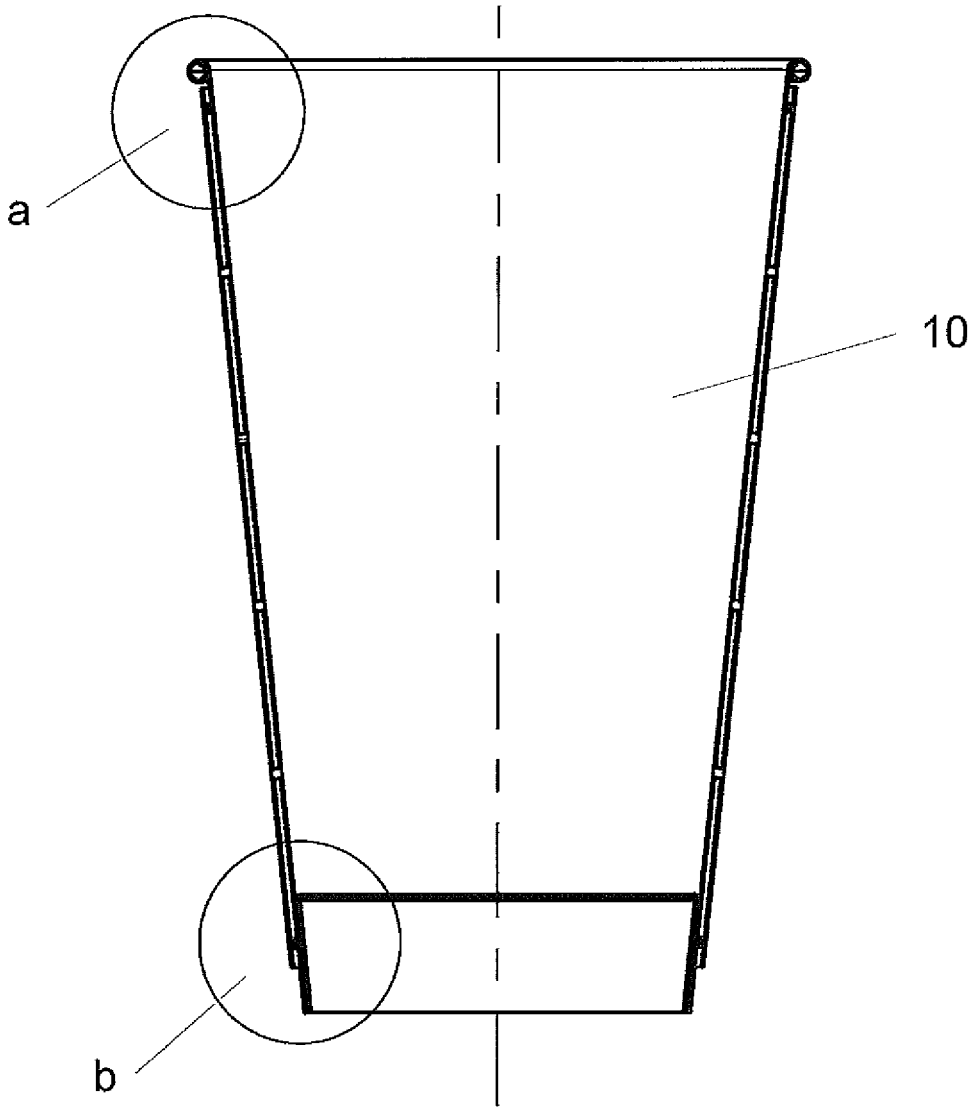
FIGS. 6, 6*a*, 6*b*, 6*c*: show a schematic sectional view through a cup according to a sixth exemplary embodiment.
Figure 6A:
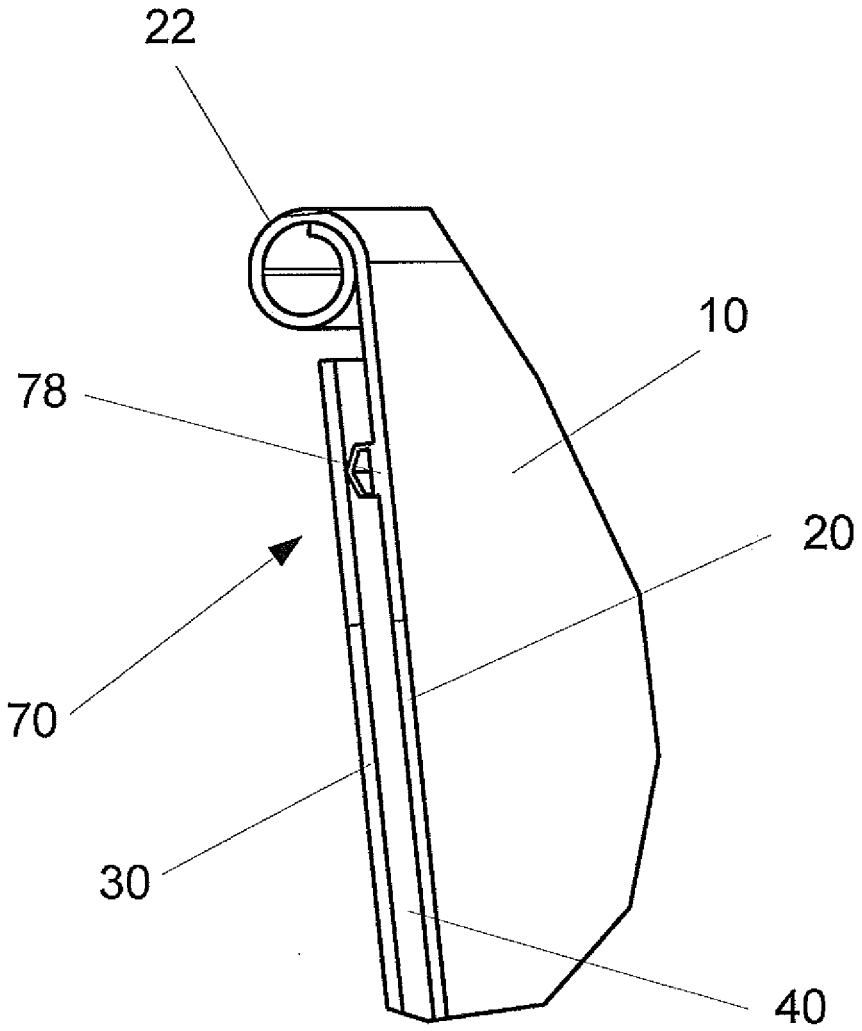
Figure 6B:
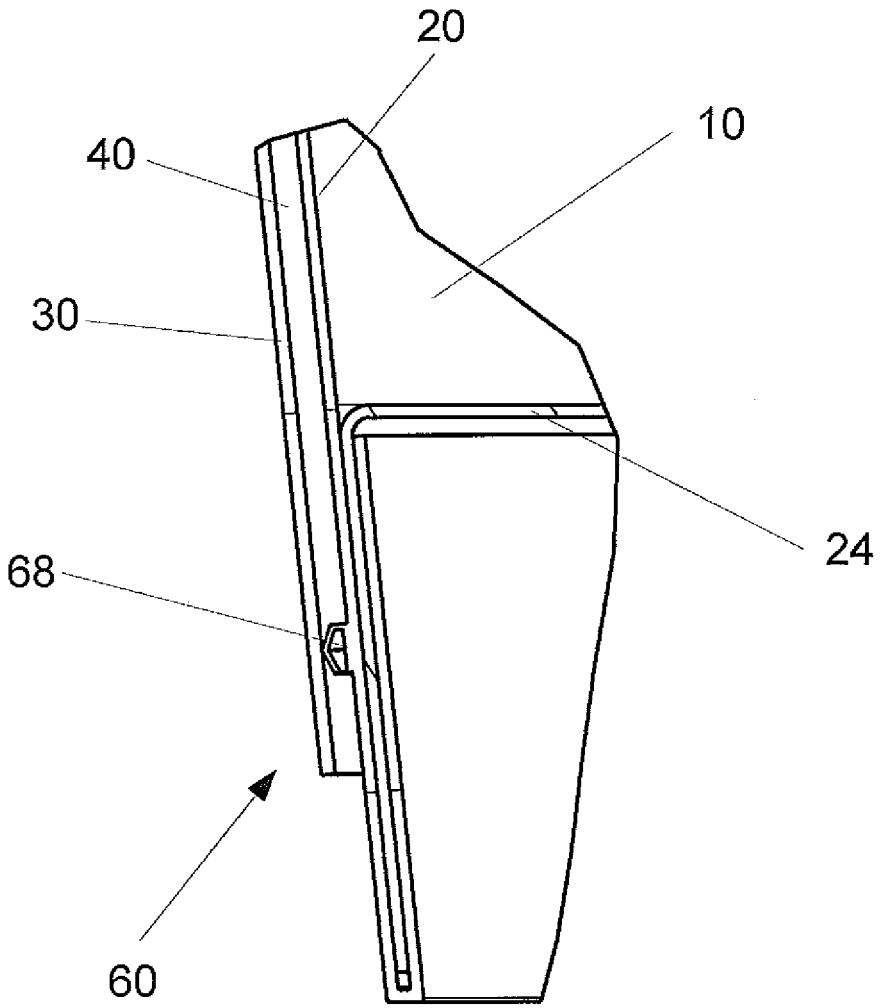
Figure 6C:
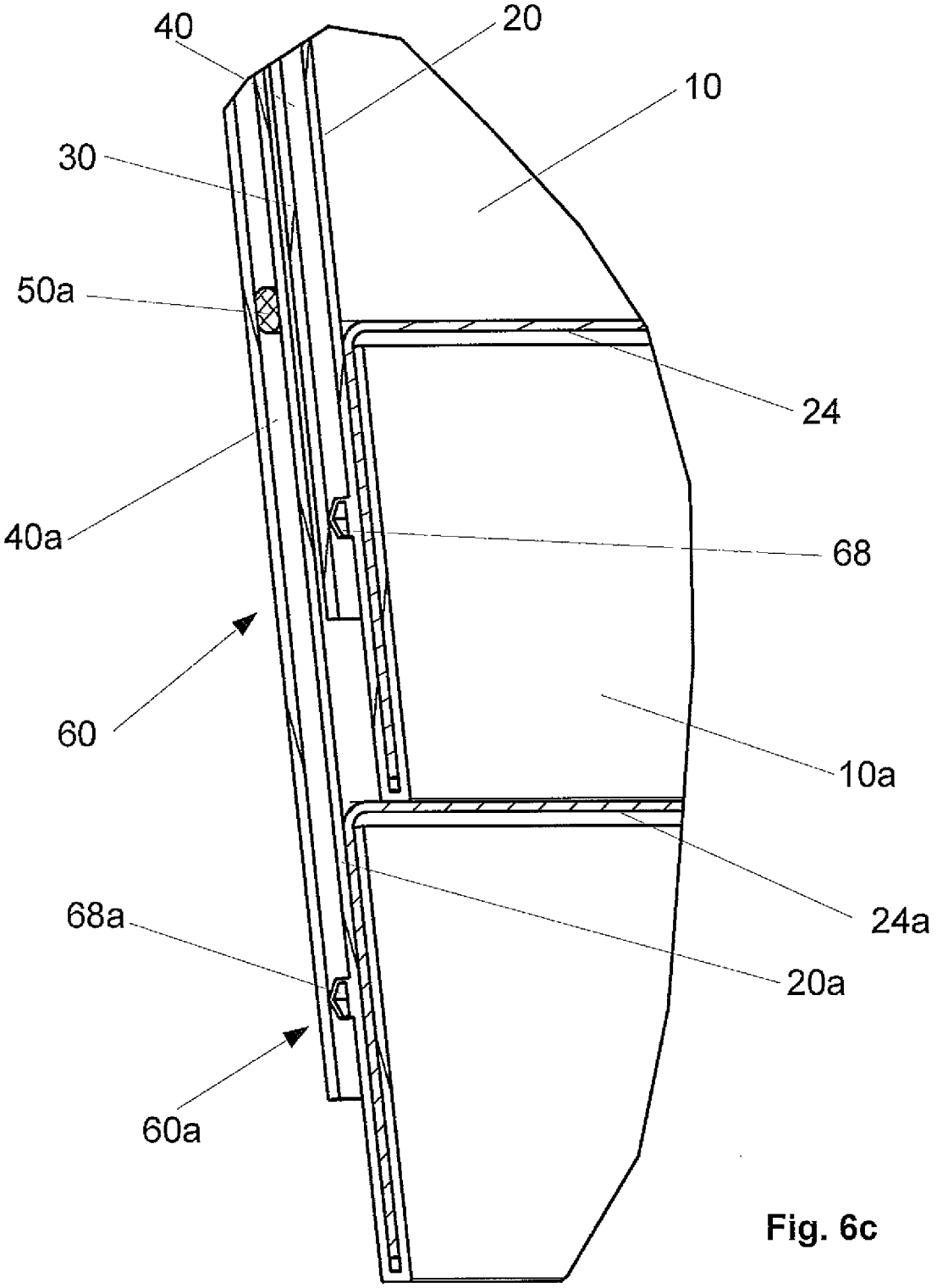

FIG. 6*c* shows in turn two cups 10, 10*a* which are stacked one in the other. The upper cup 10 is stacked here into the lower cup 10*a*. In this case there is also provision that a defined distance is maintained between the cups 10, 10*a*, wherein in contrast to the cups 10 according to the fourth and fifth exemplary embodiments there is no stacking shoulder 26 provided. Instead, the casing 20 and therefore also the skirt of the upper cup 10 are pulled so far downwards that it rests on the base 24*a* of the lower cup 10*a*, and there is still a distance present between the outer casing 30 of the upper cup 10 and the inner casing 20*a* of the lower cup 10*a*. The cup 10 can consequently not be inserted further into the lower cup 10*a*. As a result, a lower boundary for the distance between the two cups 10, 10*a* is defined and is selected in such a way that the cups 10, 10*a* cannot become caught in one another. It is therefore ensured that the cups 10, 10*a* can be separated from one another easily at any time.

FIGS. 7, 7*a*, 7*b* and 7*c* show a cup 10 according to a seventh exemplary embodiment of the invention. The lower seal 60 and the upper seal 70 are embodied here in an identical way to the sixth exemplary embodiment by means of respective sealing lips 68, 78. Therefore, reference is made to the above description and there is no repetition.

Figure 7:
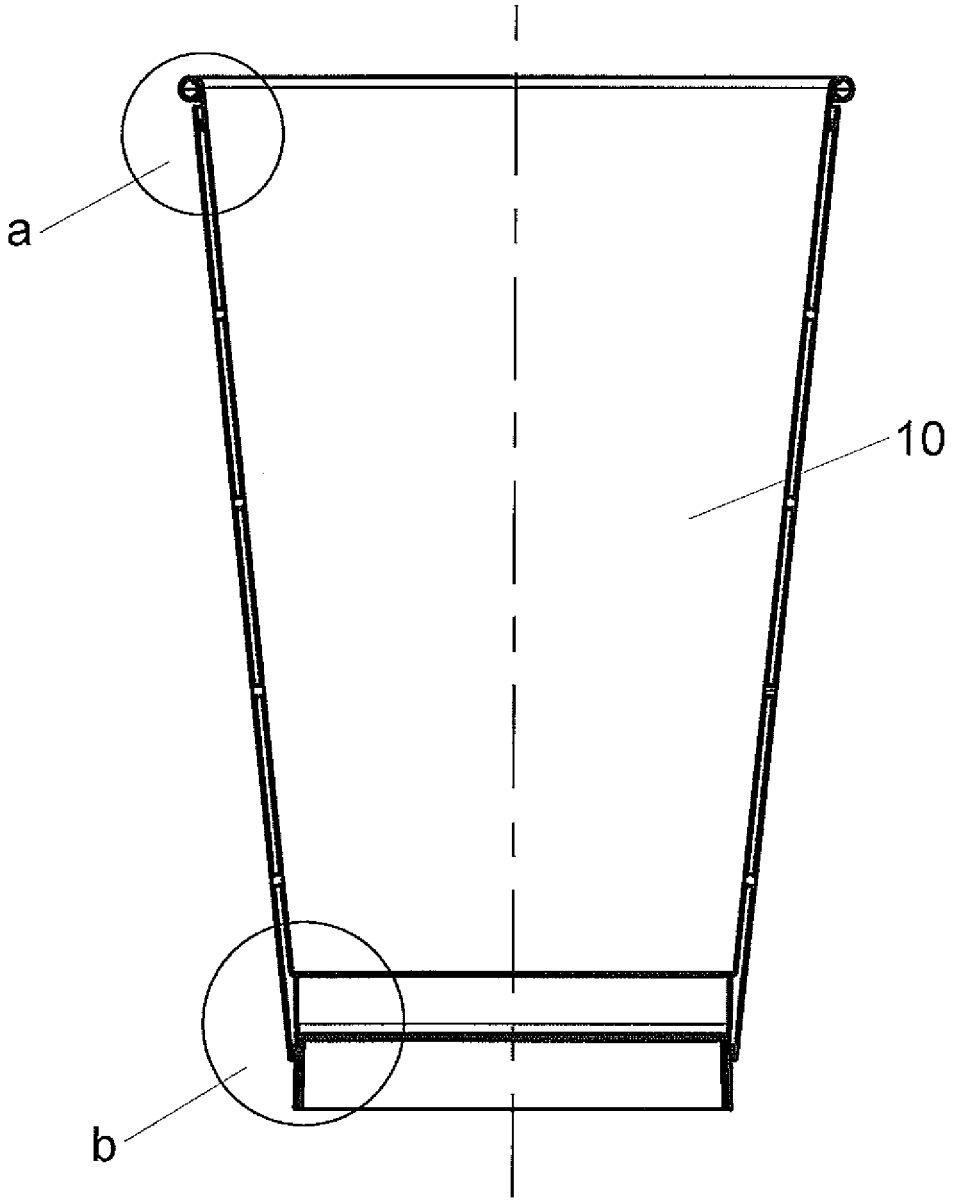
FIGS. 7, 7*a*, 7*b*, 7*c*: show a schematic sectional view through a cup according to a seventh exemplary embodiment.
Figure 7A:
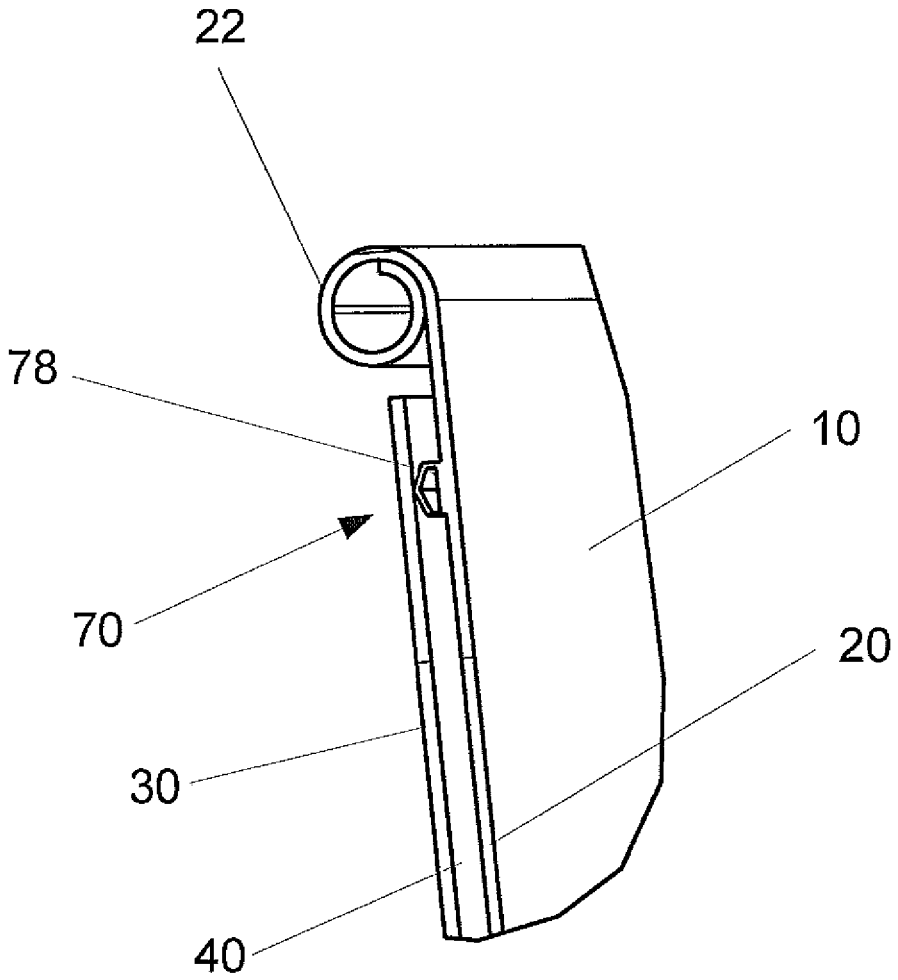
Figure 7B:
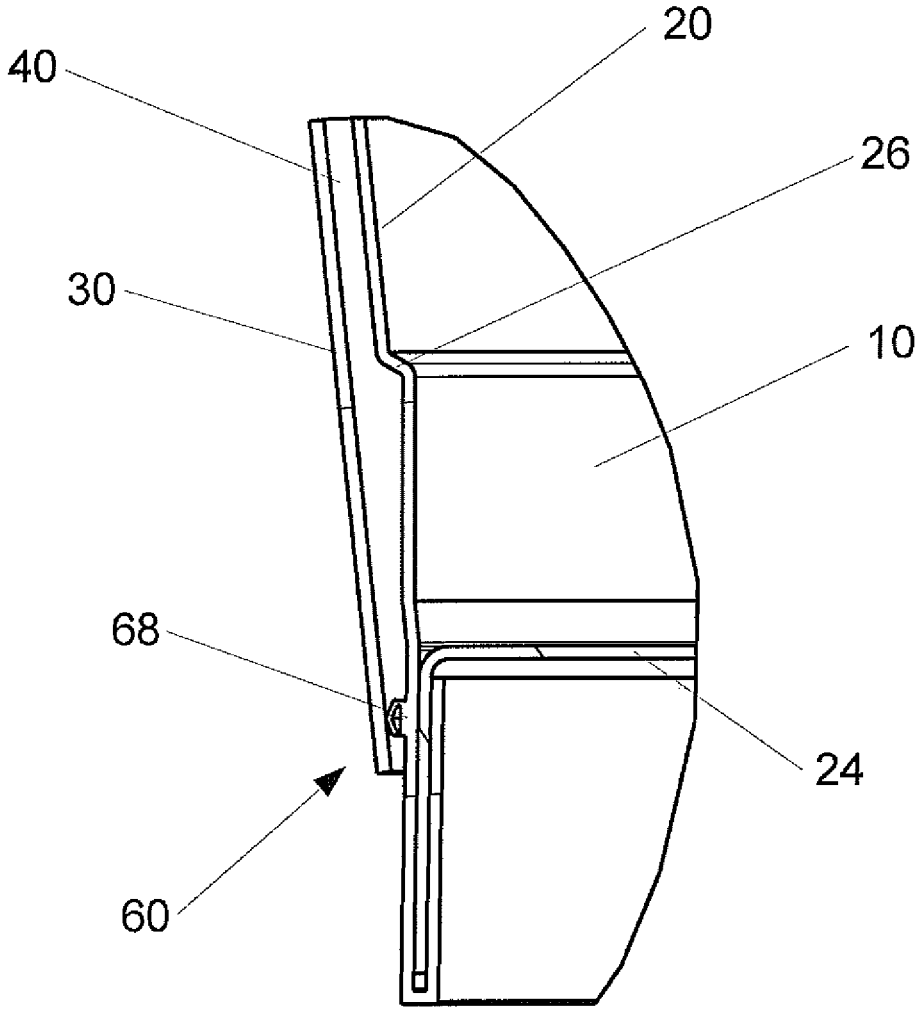
Figure 7C:
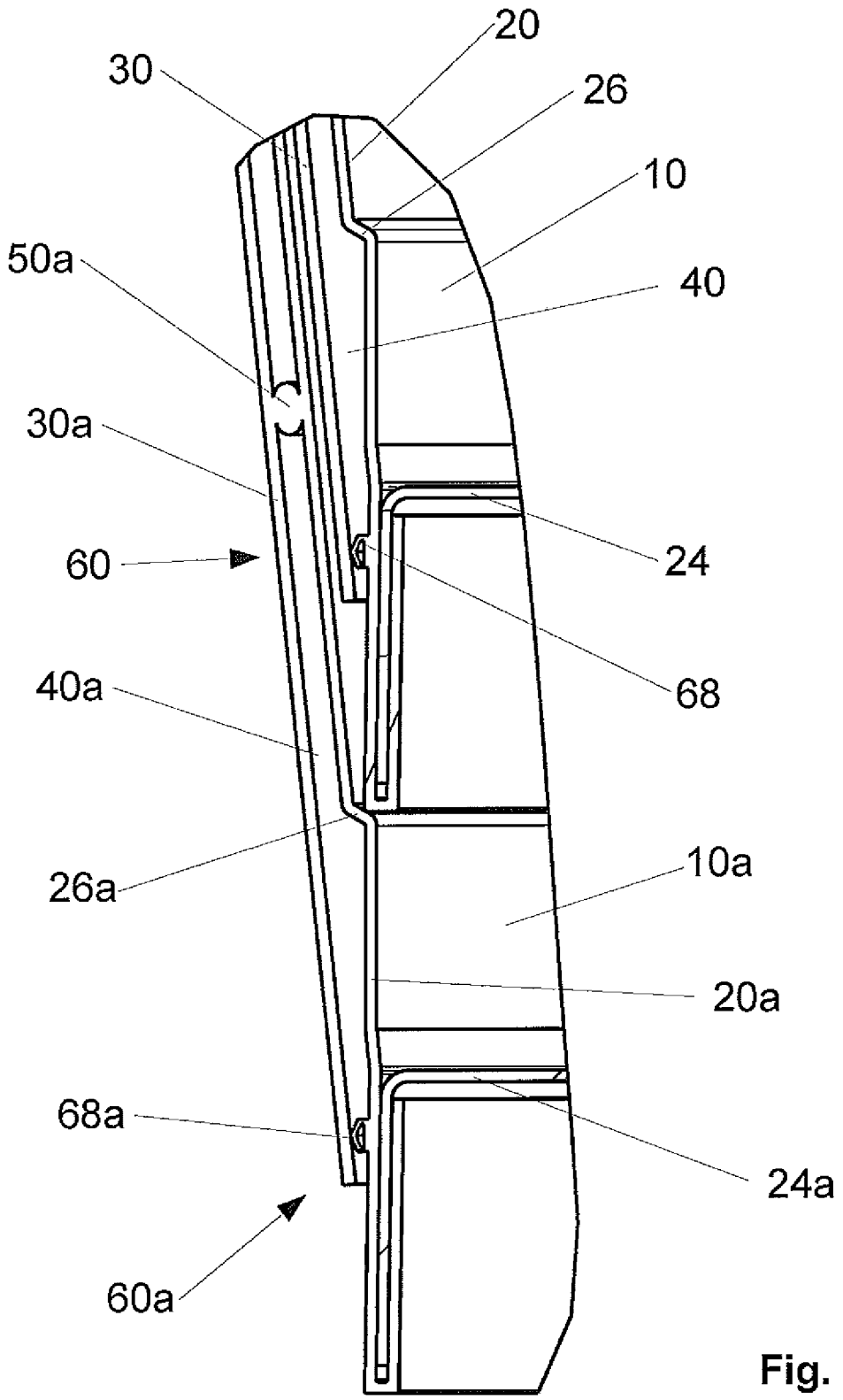

In contrast to the cup 10 according to the sixth exemplary embodiment, the cup 10 according to the seventh exemplary embodiment has in turn a stacking shoulder 26 which has already been described with reference to the fourth and fifth exemplary embodiments. In FIG. 7*c* it is, in particular, illustrated that the stacking shoulder 26*a* of the lower cup 10*a* into which an upper cup 10 is placed serves, in a form already described further above, to support the upper cup 10. Reference is made to the respective descriptions further above with respect to the individual illustrated components and the functionality of the stacking shoulder 26.

Figure 8:
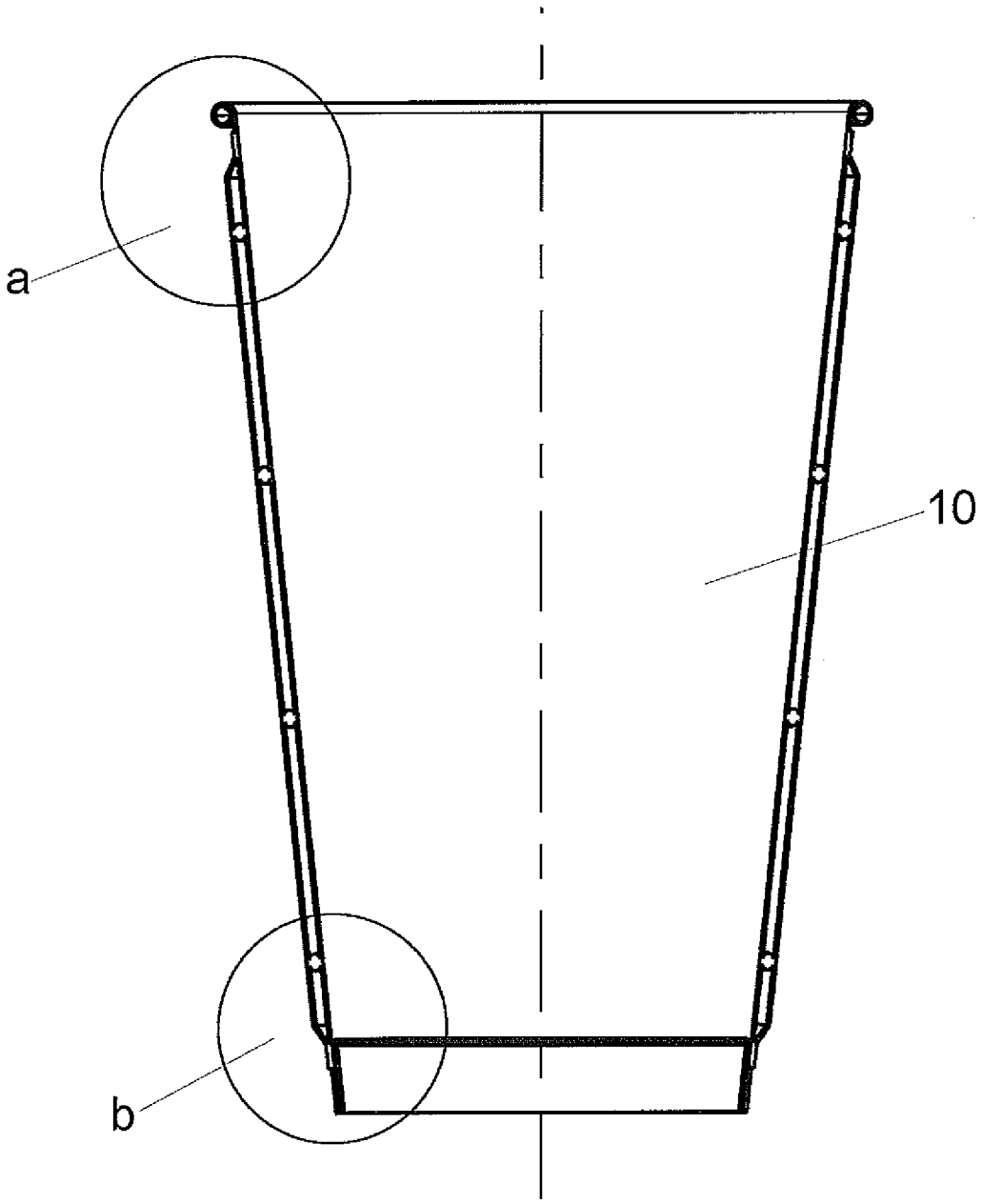
FIGS. 8, 8*a*, 8*b*: show a schematic sectional view through a cup according to an eighth exemplary embodiment.
Figure 8A:
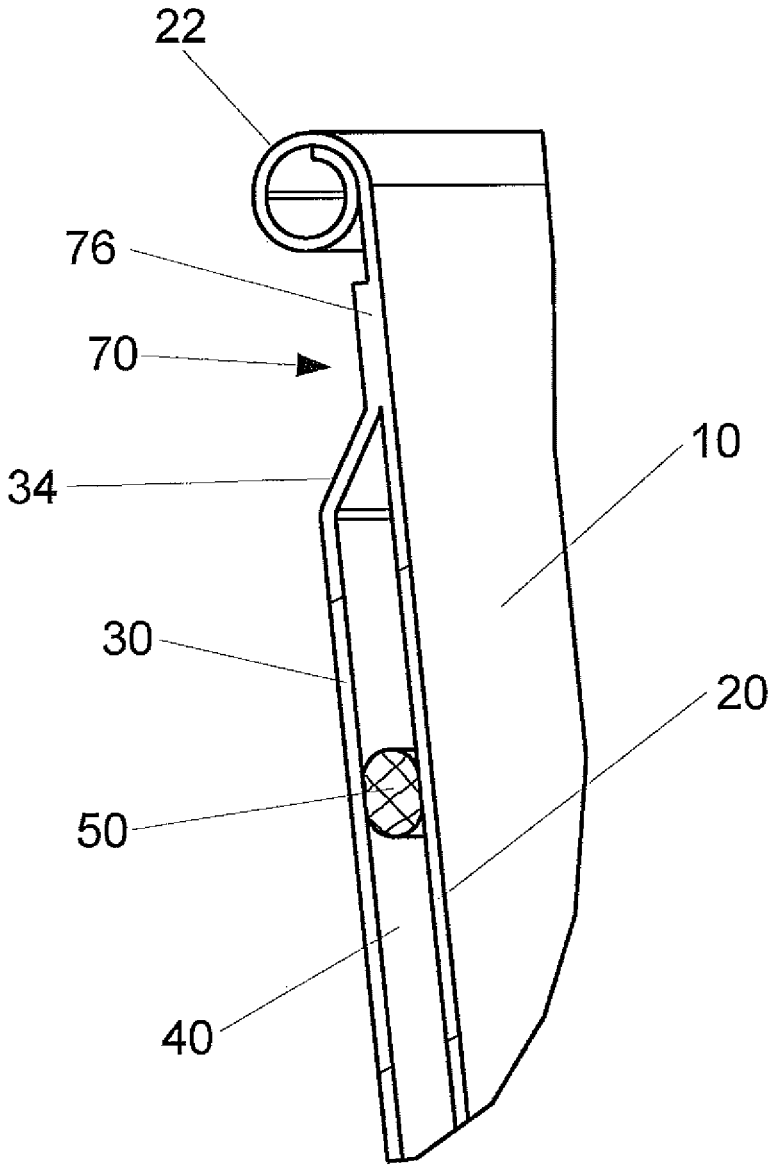
Figure 8B:
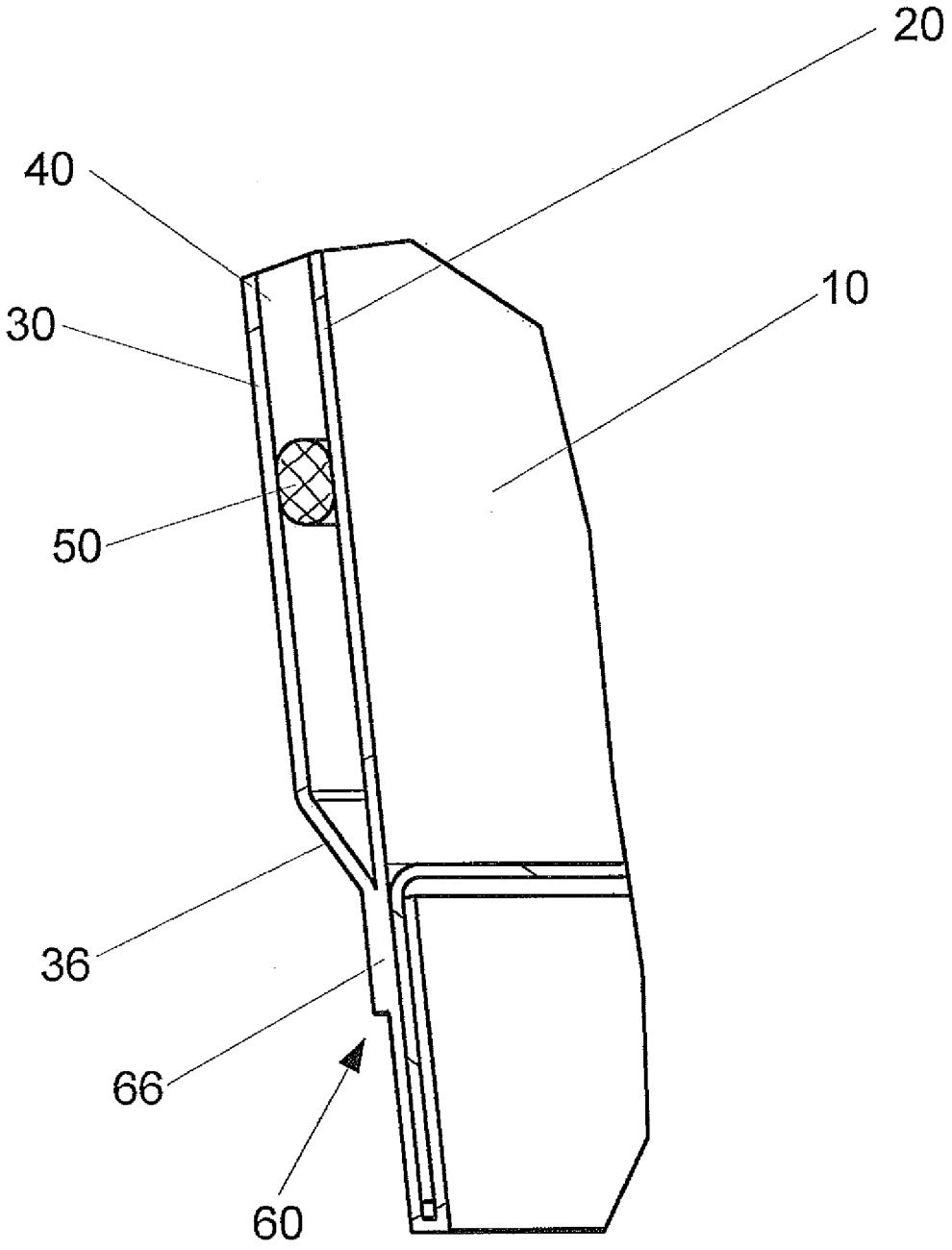

FIGS. 8, 8*a* and 8*b* show a cup 10 according to an eighth exemplary embodiment of the invention.

The upper seal 70 is embodied here in such a way that the outer casing 30 has a shoulder 34 which extends towards the casing 20. At an upper edge of the outer casing 30, the outer casing 30 is bonded to the casing 20 along an upper planar bonded connection 76. Alternatively, the planar bonded connection 76 can also be embodied as a seal. This upper planar bonded connection 76 is basically embodied similarly to that which has already been discussed further above with respect to the first exemplary embodiment. However, in contrast to the first exemplary embodiment, in the case of the cup 10 according to the eighth exemplary embodiment the casing does not have a shoulder but instead is embodied in a smooth way with the exception of the lip rim 22. Accordingly, the outer casing 30 is bent towards the casing 20 by the shoulder 34 and therefore also defines the distance between the outer casing 30 and the casing 20 which is necessary to form the insulating space 40.

The lower seal 60 is embodied in the same way as the upper seal 70. The outer casing 30 forms here a lower shoulder 36 which is bent towards the casing 20. At a lower edge of the outer casing 30, the outer casing 30 is bonded to the casing 20 along a lower planar bonded connection 66. The distance between the outer casing 30 and the casing 20 is therefore also defined.

The respective planar bonded connections 66, 76 prevent the bead-shaped insulating material 50, contained in the insulating space 40 and provided according to the eighth exemplary embodiment, from escaping from the insulating space 40.

The invention claimed is:

1. A cup comprising:

an inner casing which is conical at least in certain sections and a base forming a fillable interior;

the base being connected in an essentially fluid-tight manner to the inner casing in a region of a lower end of the interior;

an outer casing surrounding the inner casing at least in certain sections such that an insulating space is formed between the inner casing and the outer casing;

the insulating space being at least partially filled with insulating material; and a lower seal, which runs completely around a circumference, formed at least underneath the insulating material to prevent the insulating material from escaping between the inner casing and the outer casing;

wherein the lower seal comprises a circumferential bead thereby forming a materially joined connection between the inner casing and the outer casing, a material of the insulating material being different from a material of the lower seal.

2. The cup according to claim 1, wherein:

the lower seal is formed underneath the insulating material which is arranged between the inner casing and the outer casing.

3. The cup according to claim 1, wherein:

the lower seal is formed by the outer casing being bonded, adhered or sealed to the inner casing at a lower shoulder; and the lower shoulder is formed on the outer casing and extends towards the inner casing.

4. The cup according to claim 1, wherein:

the lower seal is formed by rolling the outer casing towards the inner casing and bonding, adhering or sealing the outer casing to the inner casing.

5. The cup according to claim 1, wherein:

the outer casing is spaced apart at a lower edge thereof from the inner casing, and the lower seal is embodied in such a way that the lower seal is spaced apart from the lower edge further in an upward direction.

6. The cup according to claim 5, wherein:

the lower seal comprises a circumferential adhesive bead, pulp bead or sealing bead.

7. The cup according to claim 1, wherein:

above the insulating material, a circumferential upper seal is formed completely around a circumference in order to prevent the insulating material from escaping between the inner casing and the outer casing.

8. The cup according to claim 7, wherein:

the upper seal is formed above the insulating material which is arranged between the inner casing and the outer casing.

9. The cup according to claim 7, wherein:

the upper seal is formed by bonding, adhering or sealing the outer casing to the inner casing at an upper shoulder; and the upper shoulder is formed on the outer casing and extends towards the inner casing.

10. The cup according to claim 7, wherein:

the upper seal is formed in that the outer casing is rolled towards the inner casing and is bonded, adhered or sealed to the inner casing.

11. The cup according to claim 7, wherein:

the outer casing is spaced apart at an upper edge thereof from the inner casing, and the upper seal is embodied in such a way that the upper seal is spaced apart from the upper edge further in a downward direction.

12. The cup according to claim 11, wherein:

the upper seal comprises a circumferential adhesive bead, pulp bead or sealing bead or a sealing lip.

13. The cup according to claim 1, wherein:

a number of completely circumferential, central seals are arranged between the inner casing and the outer casing; and the insulating material is arranged both underneath and above each central seal.

14. The cup according to claim 1, wherein:

the insulating material is formed in one or more large-area layers and/or in one or more circumferential beads.

15. The cup according to claim 1, wherein:

a number of central bonding points are arranged between the inner casing and the outer casing; and the central bonding points are arranged over the lower seal and under an upper edge of the outer casing and/or an upper seal.

16. A method for manufacturing a cup according to claim 1, the method including the following steps:

essentially fluid-tight connecting the inner casing and the base;

applying the insulating material to the inner casing;

attaching the outer casing to the inner casing; and forming the lower seal to prevent the insulating material from escaping between the outer casing and the inner casing.

17. A method for manufacturing a cup, the method including the following steps:

essentially fluid-tight connecting a conical inner casing and a base;

applying an insulating material to the inner casing;

attaching an outer casing to the inner casing; and forming a lower seal to prevent the insulating material from escaping between the outer casing and the inner casing;

wherein the lower seal comprises a circumferential bead thereby forming a materially joined connection between the inner casing and the outer casing, a material of the insulating material being different from a material of the lower seal.

18. A cup comprising:

an inner casing which is conical at least in certain sections and a base forming a fillable interior;

the base being connected in an essentially fluid-tight manner to the inner casing in a region of a lower end of the interior;

an outer casing surrounding the inner casing at least in certain sections such that an insulating space is formed between the inner casing and the outer casing;

the insulating space being at least partially filled with insulating material; and a lower seal, which runs completely around a circumference, formed at least underneath the insulating material to prevent the insulating material from escaping between the inner casing and the outer casing;

wherein the insulating material has a certain degree of porosity or brittleness to allow the insulating material to crumble.

* * * * *